US009216575B2

(12) United States Patent
Tamatsukuri et al.

(10) Patent No.: US 9,216,575 B2
(45) Date of Patent: Dec. 22, 2015

(54) RECORDING-ELEMENT SUBSTRATE AND LIQUID EJECTION APPARATUS

(71) Applicant: CANON KABUSHIKI KAISHA, Tokyo (JP)

(72) Inventors: Shuichi Tamatsukuri, Asaka (JP); Makoto Sakurai, Kawasaki (JP); Sadayoshi Sakuma, Oita (JP); Masaya Uyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/683,470

(22) Filed: Apr. 10, 2015

(65) Prior Publication Data

US 2015/0290935 A1 Oct. 15, 2015

(30) Foreign Application Priority Data

Apr. 15, 2014 (JP) ..... 2014-083633

(51) Int. Cl.
*B41J 2/05* (2006.01)
*B41J 2/14* (2006.01)
*B41J 2/045* (2006.01)

(52) U.S. Cl.
CPC ..... *B41J 2/14112* (2013.01); *B41J 2/0458* (2013.01); *B41J 2/04541* (2013.01)

(58) Field of Classification Search
CPC ... B41J 2/14112; B41J 2/04541; B41J 2/0458
See application file for complete search history.

(56) References Cited

U.S. PATENT DOCUMENTS 7,458,661 B2 * 12/2008 Kim et al. ..... 347/47

FOREIGN PATENT DOCUMENTS

| | | | |
|---|---|---|---|
| JP | 55-132259 | A | 10/1980 |
| JP | 63-191644 | A | 8/1988 |
| JP | 2010-042629 | A | 2/2010 |

* cited by examiner

*Primary Examiner* — Juanita D Jackson
(74) *Attorney, Agent, or Firm* — Canon USA, Inc. IP Division

(57) ABSTRACT

A recording-element substrate includes an ejection port configured to eject liquid; a heating resistance element configured to generate thermal energy for ejecting the liquid from the ejection port; and a drive circuit configured to drive the heating resistance element. The heating resistance element includes a heating resistor layer and three pairs of electrodes provided for the heating resistor layer. The drive circuit forms a heating area that generates thermal energy in the heating resistor layer by selectively using two or more of the electrodes.

20 Claims, 35 Drawing Sheets

RECORDING-ELEMENT SUBSTRATE AND LIQUID EJECTION APPARATUS

BACKGROUND

1. Field of the Invention

The present disclosure relates to a recording-element substrate of a liquid ejection apparatus typified by an inkjet recording apparatus.

2. Description of the Related Art

Higher-quality higher-durability (long life) liquid ejection apparatuses are required.

Japanese Patent Laid-Open No. 55-132259 discloses a recording head that provides a high-quality image. This recording head has a plurality of heaters in each of channels communicating with ejection ports. The heaters are configured to be able to supply pulse signals individually. By controlling the supply timing of pulse signals to the heaters, the size of droplets ejected from the ejection ports is adjusted. By adjusting the size of the droplets, an image at high gray level is provided.

Japanese Patent Laid-Open No. 2010-42629 discloses a liquid ejection apparatus that provides a high-quality image. This liquid ejection apparatus has a pair of heating elements in each liquid chamber. The liquid chamber communicates with one nozzle. The heating elements are opposed to the nozzle.

If pulsed currents with the same value are supplied to the heating elements, liquid is ejected in a first direction from the nozzle. If pulsed currents with different values are supplied to the individual heating elements, liquid is ejected in a second direction different from the first direction. Controlling the ejecting direction with pulsed current values allows adjustment of droplet landing positions, thus allowing providing a high-quality image.

Japanese Patent Laid-Open No. 63-191644 discloses an inkjet recording apparatus that has achieved high durability. This inkjet recording apparatus has a plurality of heater units for one ejection port. The heater units are connected to a pair of electrode in parallel. The heater units heat liquid to generate bubbles, so that the liquid is ejected from the ejection port.

It is known that a heater is damaged due to pressure fluctuations, a so-called cavitation impact, caused due to a series of processes, that is, generation, growth, and shrinkage of bubbles. With the inkjet recording apparatus disclosed in Japanese Patent Laid-Open No. 63-191644, even if part of the heater units is damaged due to a cavitation impact, liquid can be ejected using the other heater units. Thus, the high durability of the heaters is achieved.

SUMMARY OF THE INVENTION

According to an aspect disclosed herein, a recording-element substrate or a liquid ejection apparatus equipped with the recording-element substrate is provided. The recording-element substrate includes an ejection port configured to eject liquid; a heating resistance element configured to generate thermal energy for ejecting the liquid from the ejection port; and a drive circuit configured to drive the heating resistance element. The heating resistance element includes a heating resistor layer and three or more electrodes provided for the heating resistor layer. The drive circuit forms a heating area that generates thermal energy in the heating resistor layer by selectively using at least two of the three or more electrodes and changes an area in which the heating area is formed depending on the electrodes used. The three or more electrodes include a plurality of first electrodes that allow an electric current to flow through a first area and a plurality of second electrodes that allow an electric current to flow through a second area adjacent to the first area. A center of the first area coincides with a center of an area including the first area and the second area.

According to another aspect disclosed herein, a recording-element substrate or a liquid ejection apparatus equipped with the recording-element substrate is provided. The recording-element substrate includes an ejection port configured to eject liquid; a heating resistance element configured to generate thermal energy for ejecting the liquid from the ejection port; and a drive circuit configured to drive the heating resistance element. The heating resistance element includes a heating resistor layer and three or more electrodes provided for the heating resistor layer. The drive circuit forms a heating area that generates thermal energy in the heating resistor layer by selectively using at least two of the three or more electrodes and changes an area in which the heating area is formed depending on the electrodes used. The three or more electrodes include a plurality of first electrodes that allow an electric current to flow through a first area and a plurality of second electrodes that allow an electric current to flow through a second area larger than the first area. A center of the first area coincides with a center of the second area.

Further features of the present disclosure will become apparent from the following description of exemplary embodiments with reference to the attached drawings.

BRIEF DESCRIPTION OF THE DRAWINGS

FIG. 11A is a schematic plan view of the heating area of the heating resistance element when the head unit of the liquid ejection apparatus shown in FIG. 10A moves in the direction of arrow a.

DESCRIPTION OF THE EMBODIMENTS

All of the apparatuses disclosed in Japanese Patent Laid-Open Nos. 55-132259, 2010-42629, and 63-191644 have a plurality of heating resistance elements (heaters or heating elements) for one ejection port. This increases the sizes of the recording-element substrates and also the costs thereof.

The present disclosure provides a recording-element substrate with high quality or high durability and having a reduced size and cost, as well as a liquid ejection apparatus including the same.

Embodiments of the present disclosure will be described in detail hereinbelow with reference to the drawings.

First Embodiment

Figure 1A:
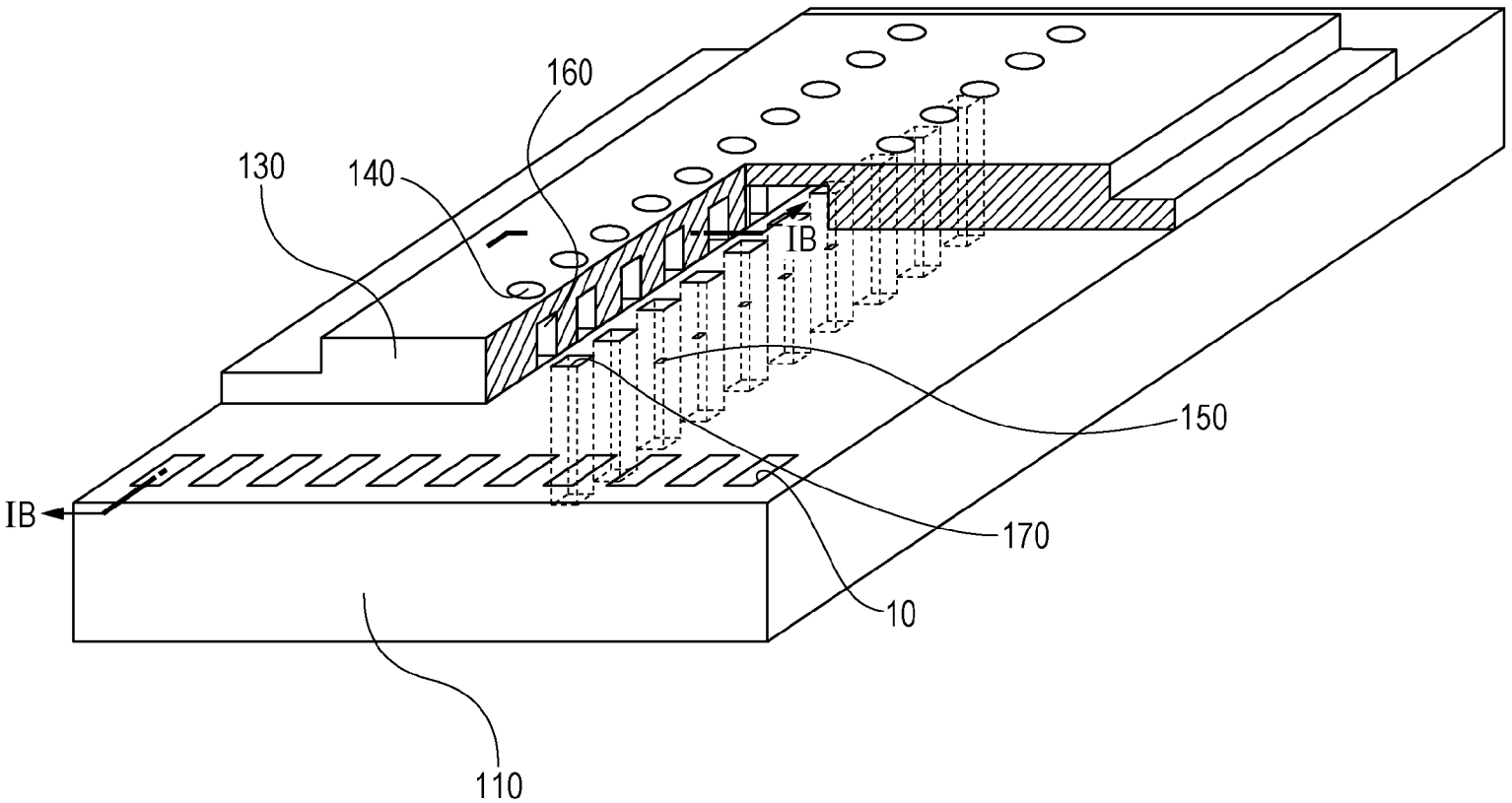
FIG. 1A is a schematic perspective view of a recording-element substrate.

FIG. 1A is a schematic perspective view of a recording-element substrate according to a first embodiment.

The recording-element substrate of this embodiment is mounted on a liquid ejection head and includes a silicon substrate 110 and a channel-formed member 130 provided on the substrate 110, as shown in FIG. 1A. In FIG. 1A, part of the channel-formed member 130 is cut away for the convenience of description of the internal structure.

The channel-formed member 130 includes a plurality of ejection ports 140. A pressure chamber 160 communicating with each of the ejection ports 140 is provided for each ejection port 140. The substrate 110 has liquid supply ports 170 for supplying liquid to the pressure chambers 160. In the configuration example shown in FIG. 1A, although the liquid supply ports 170 are provided for the individual pressure chambers 160, the present disclosure is not limited thereto. For example, liquid may either be supplied to the plurality of pressure chambers 160 through one liquid supply port 170 or be supplied to one pressure chamber 160 through a plurality of liquid supply ports 170.

A plurality of terminals 10, a plurality of heating resistance elements 150, drive circuits for driving the heating resistance elements 150, and wiring lines are provided on the substrate 110. The heating resistance elements 150 are provided for the individual ejection ports 140 and generate thermal energy for ejecting liquid through the ejection ports 140. Electric power and signals for operating the liquid ejection head are supplied to the terminals 10. The drive circuits operate upon receiving electric power and signals through the terminals 10 to drive the heating resistance elements 150.

Figure 1B:
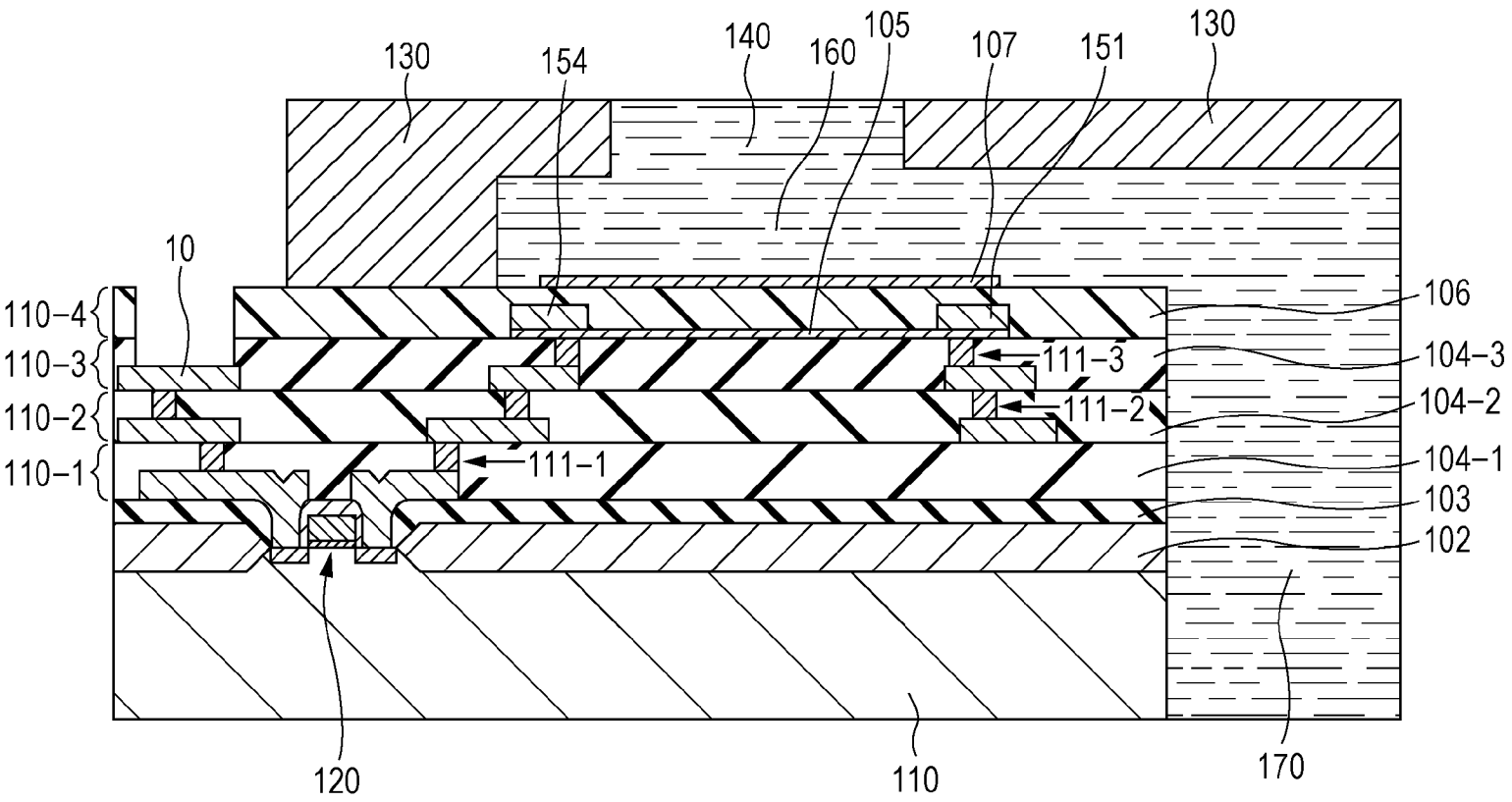
FIG. 1B is a schematic cross-sectional view showing a cross-section structure of the recording-element substrate shown in FIG. 1A.

FIG. 1B is a schematic cross-sectional view showing a cross-section structure of the recording-element substrate shown in FIG. 1A taken along line IB-IB in a direction perpendicular to the substrate surface.

As shown in FIG. 1B, a thermally oxidized layer 102 is formed on the substrate 110 by thermally oxidizing part of the substrate 110. An area separated by the thermally oxidized layer 102 is provided with driving elements 120, such as transistors.

Boronphosphosilicate glass (BPSG) 103 and interlayer insulation films 104-1 to 104-3 are formed using a chemical vapor deposition (CVD) method or the like on the substrate 110 on which the thermally oxidized layer 102 and the driving element 120 are formed. The BPSG 103 and the interlayer insulation films 104-1 to 104-3 are composed of silicon compounds. Example materials of the interlayer insulation films 104-1 to 104-3 may include insulating materials, such as SiO, SiON, and SiOC. Furthermore, wiring layers 110-1 to 110-4, vias 111-1 to 111-3, a heating resistor layer 105, electrodes 151 and 154, a passivation layer 106, an anti-cavitation layer 107, and the terminals 10 are formed on the substrate 110. The wiring layers 110-1 to 110-4 are composed of an Al compound, such as Al—Si or Al—Cu. The terminals 10 are electrically connected to the driving elements 120 and the electrodes 151 and 154 via the wiring layers 110-1 to 110-4 and the vias 111-1 to 111-3.

A procedure for forming the structure shown in FIG. 1B will be briefly described hereinbelow.

The BPSG 103 is formed, and then the first wiring layer 110-1 is formed. Specifically, an Al—Si film is formed using a sputtering method, and wiring lines connected to the source and the drain of the driving elements 120 are formed by a lithography process and a dry etching process. These wiring lines constitute the first wiring layer 110-1.

After the first wiring layer 110-1 is formed, the first interlayer insulation film 104-1 is formed using the CVD method and is then smoothed using a chemical mechanical polishing (CMP) method. The first interlayer insulation film 104-1 is subjected to the lithography process and the dry etching process to form a pattern for the first vias 111-1. Subsequently, a TiN film is formed using the sputtering method, and thereafter, a tungsten (W) film is formed using the CVD method. Excess W and TiN are removed by dry etching to form the first vias 111-1 filled with W.

Subsequently, an Al—Cu film is formed using the sputtering method. The Al—Cu film is then subjected to the lithography process and the dry etching process to form a wiring line with a given pattern that are electrically connected to the first vias 111-1. These wiring lines constitute the second wiring layers 110-2.

By repeating the same process as that describe above, the second interlayer insulation film 104-2, the second vias 111-2, the third wiring layer 110-3, the third interlayer insulation film 104-3, and the third vias 111-3 are formed in sequence.

After the third vias 111-3 are formed, the heating resistor layer 105 composed of TaSiN or WSiN is formed using the sputtering method. Then the fourth wiring layer 110-4 composed of Al—Cu is formed on the heating resistor layer 105 using the sputtering method.

The fourth wiring layer 110-4 and the heating resistor layer 105 are collectively subjected to patterning by the lithography process and the dry etching process. Thereafter, the fourth wiring layer 110-4 is subjected to a wet etching process to form the electrodes 151 and 154.

The electrodes 151 and 154 are a pair of electrodes. A plurality of pairs of electrodes 151 and 154 are formed for one heating resistor layer 105. The heating resistance elements 150 shown in FIG. 1A are each formed of the heating resistor layer 105 and the plurality of pairs of electrodes 151 and 154.

After the electrodes 151 and 154 are formed, the passivation layer 106 formed of an insulating material, such as a silicon compound, SiN or SiCN. The heating resistance elements 150 are coated with the passivation layer 106 to insulate the heating resistance elements 150 from liquid to be ejected.

After the passivation layer 106 is formed, a metal film formed of Ta, Ir, or Ru is formed using the sputtering method. The anti-cavitation layer 107 is formed in the area on the heating resistance elements 150 of the passivation layer 106 by the lithography process and the dry etching process. The anti-cavitation layer 107 protects the heating resistance elements 150 from a cavitation impact or the like.

After the anti-cavitation layer 107 is formed, part of the passivation layer 106 and the third interlayer insulation film 104-3 is removed by the lithography process and the dry etching process. The terminals 10 are formed in the resultant areas.

After the terminals 10 are formed, part of the substrate 110 is removed using the dry etching method or a sandblasting method. Part of the thermally oxidized layer 102, the BPSG 103, the interlayer insulation films 104-1 to 104-3, and the passivation layer 106 are removed by the wet etching process and the dry etching process to form the liquid supply ports 170.

Finally, the channel-formed member 130 is formed on the passivation layer 106. To enhance the adhesiveness between the passivation layer 106 and the channel-formed member 130, an adhesive layer formed of a polyether amide resin or the like may be provided between the passivation layer 106 and the channel-formed member 130.

Figure 1C:
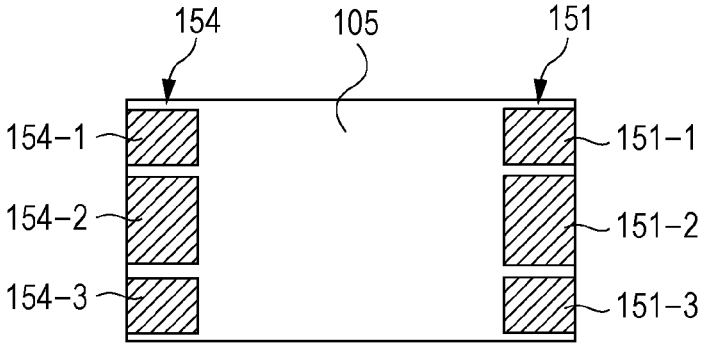
FIG. 1C is a schematic plan view of a heating resistance element provided on the recording-element substrate shown in FIG. 1A.

FIG. 1C is a schematic plan view of one of the heating resistance elements 150.

As shown in FIG. 1C, the heating resistance element 150 includes one heating resistor layer 10 and a plurality of electrodes 151-1 to 151-3 and 154-1 to 154-3. The electrodes 151-1 to 151-3 are formed at regular intervals on one of two opposing sides of the heating resistor layer 105, and the electrodes 154-1 to 154-3 are formed at regular intervals on the other side. The electrode 151-1 and the electrode 154-1 constitute a pair of electrodes opposed to each other. Likewise, the electrode 151-2 and the electrode 154-2, and the electrode 151-3 and the electrode 154-3 also each constitute a pair of electrodes opposed to each other.

The drive circuit for the heating resistance element 150 can supply electric power to the first pair of electrodes 151-1 and 154-1, the second pair of electrodes 151-2 and 154-2, and the third pair of electrodes 151-3 and 154-3 individually in response to signals supplied via the terminal 10.

Figure 1D:
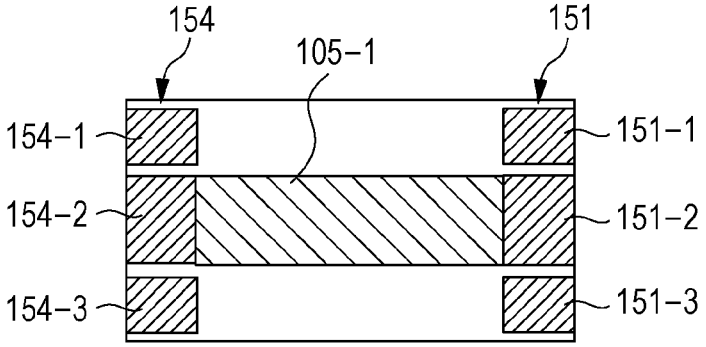
FIG. 1D is a schematic plan view showing an example of the driving state of the heating resistance element shown in FIG. 1C.

For example, as shown in FIG. 1D, the drive circuit can drive the heating resistance element 150 by supplying electric power to the second pair of electrodes 151-2 and 154-2. In this case, a heating area 105-1 is formed of the area between the electrode 151-2 and the electrode 154-2 of the heating resistor layer 105. Liquid is ejected from the ejection port 140 using thermal energy generated from the heating area 105-1.

Figure 1E:
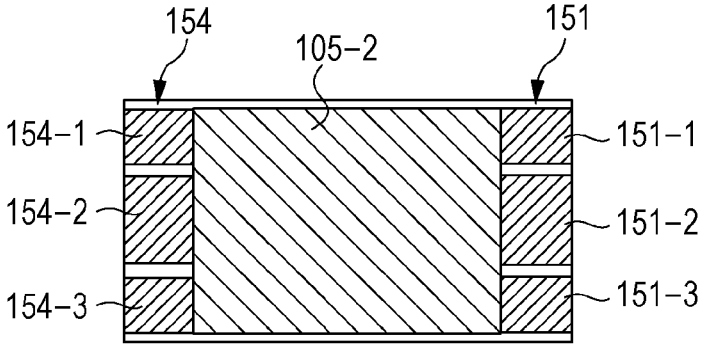
FIG. 1E is a schematic plan view showing another example of the driving state of the heating resistance element shown in FIG. 1C.

As shown in FIG. 1E, the drive circuit can drive the heating resistance element 150 by supplying electric power to the first pair of electrodes 151-1 and 154-1, the second pair of electrodes 151-2 and 154-2, and the third pair of electrodes 151-3 and 154-3 individually. In this case, a heating area 105-2 is formed of the entire area of the heating resistor layer 105. The thermal energy generated from the heating area 105-2 causes the liquid to be ejected from the ejection port 140.

Circuit Configuration

Next, the circuit configuration of the recording-element substrate will be described.

Figure 2:
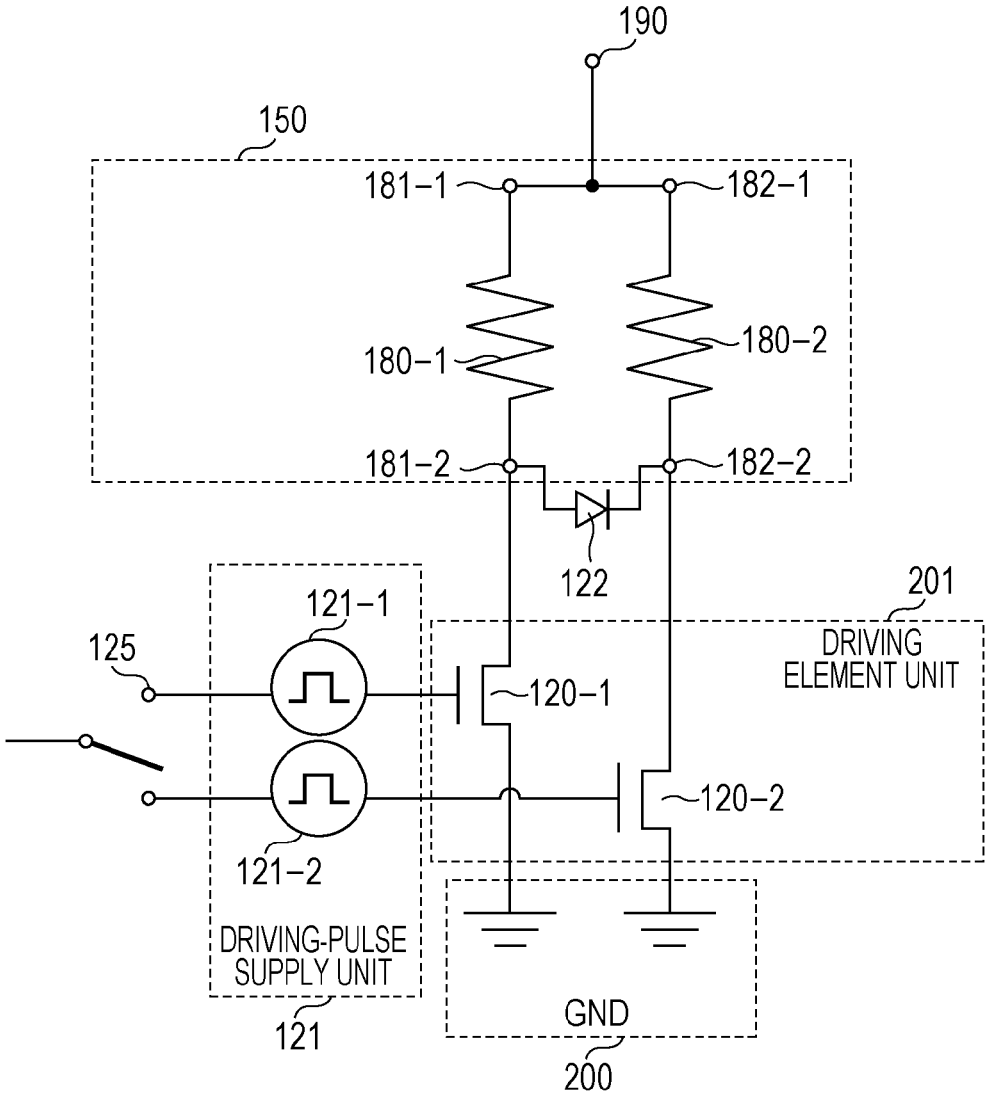
FIG. 2 is a circuit diagram showing an example of a circuit of the recording-element substrate shown in FIG. 1A.

FIG. 2 is a circuit diagram showing an example of a circuit of the recording-element substrate shown in FIG. 1A.

As shown in FIG. 2, the circuit of the recording-element substrate includes an electrode 190, the heating resistance element 150, a diode 122, a driving element unit 201, a driving-pulse supply unit 121, and a switching element 125. Electric power is supplied to the electrode 190 via the terminal 10.

The heating resistance element 150 includes electrodes 181-1, 181-2, 182-1, and 182-2 and resistors 180-1 and 180-2.

One end of the resistor 180-1 is connected to the electrode 181-1, and the other end is connected to the electrode 181-2. One end of the resistor 180-2 is connected to the electrode 182-1, and the other end is connected to the electrode 182-2. The electrode 181-1 and the electrode 182-1 are connected together, of which connection line the electrode 190 is connected to.

The resistor 180-1 corresponds to a resistor formed of the area between the second pair of electrodes 151-2 and 154-2 in the heating resistor layer 105 shown in FIG. 1C. In other words, the resistor 180-1 corresponds to the resistor in the heating area 105-1 shown in FIG. 1D. The electrodes 181-1 and 181-2 correspond to the electrodes 151-2 and 154-2, respectively.

The resistor 180-2 corresponds to a resistor formed of the area between the first pair of electrodes 151-1 and 154-1 and the area between the third pair of electrodes 151-3 and 154-3 of the heating resistor layer 105 shown in FIG. 1C. The area between the first pair of electrodes 151-1 and 154-1 is next to one of the sides of the area between the second pair of electrodes 151-2 and 154-2. The area between the third pair of electrodes 151-3 and 154-3 is next to the other of the sides of the area between the second pair of electrodes 151-2 and 154-2. The electrode 182-1 corresponds to the electrode unit of the electrodes 151-1 and 151-3, and the electrode 182-2 corresponds to the electrode unit of the electrodes 154-1 and 154-3.

The driving element unit 201 includes driving elements 120-1 and 120-2, such as transistors. The driving elements 120-1 and 120-2 are the driving element 120 shown in FIG. 1B. Although FIG. 1B shows only one driving element 120, a driving element with the same structure is provided next to the driving element 120. These driving elements constitute the driving elements 120-1 and 120-2.

One of the source and the drain of the driving element 120-1 is connected to a GND 200, and the other is connected to the electrode 181-2. Likewise, one of the source and the drain of the driving element 120-2 is connected to the GND 200, and the other is connected to the electrode 182-2. The GND 200 is grounded via the terminal 10.

The diode 122 is disposed between the electrode 181-2 and the electrode 182-2. The anode of the diode 122 is connected to the electrode 181-2, and the cathode is connected to the electrode 182-2. The diode 122 works so that no electric current flows from the electrode 190 to the driving element 120-1 via the resistor 180-2.

The driving-pulse supply unit 121 includes driving pulse circuits 121-1 and 121-2 that output driving pulse signals and is configured such that one of the driving pulse circuits 121-1 and 121-2 is selected by the switching element 125.

A driving pulse signal output from the driving pulse circuit 121-1 is supplied to the gate terminal of the driving element 120-1. A driving pulse signal output from the driving pulse circuit 121-2 is supplied to the gate terminal of the driving element 120-2.

The driving element unit 201, the driving-pulse supply unit 121, and the switching element 125 constitute a drive circuit for driving the heating resistance element 150. Note that the drive circuit is given for mere illustration and can be changed in configuration as needed. For example, the switching element 125 may be provided outside the drive circuit. The drive circuit may include other elements and circuits for driving the heating resistance element 150.

Although not shown, the recording-element substrate includes, as circuits thereof, a shift resistor to which image data is serially input and a latch circuit that temporarily stores data output from the shift resistor. The switching element 125 selects one of the driving pulse circuits 121-1 and 121-2 on the basis of the data stored in the latch circuit. The driving pulse circuits 121-1 and 121-2 each output a driving pulse signal based on the data stored in the latch circuit. The pulse widths of the driving pulse signals output from the driving pulse circuits 121-1 and 121-2 are set as appropriate depending on the amounts (sizes) of droplets to be ejected. Although the pulse widths of the signals output from the driving pulse circuits 121-1 and 121-2 here are set to different values, this is not intended to limit the present disclosure. The pulse widths may be equal to each other. In this case, the number and pitch of vias that form the electrodes of the heating resistance element 150 and the widths and lengths of wiring layers (wiring resistors) are adjusted to make the amount (size) of droplets different.

First Driving Operation

The switching element 125 selects the driving pulse circuit 121-1. The driving element 120-1 operates in response to a driving pulse signal output from the driving pulse circuit 121-1, so that an electric current flows through the resistor 180-1. This causes thermal energy to be generated in the heating area 105-1 shown in FIG. 1D, and the liquid in the pressure chamber 160 is heated by the thermal energy to generate bubbles. The liquid is ejected from the ejection port 140 through a series of processes, that is, generation, growth, and shrinkage of bubbles.

Second Driving Operation

The switching element 125 selects the driving pulse circuit 121-2. The driving element 120-2 operates in response to a driving pulse signal output from the driving pulse circuit 122-1, so that current flows through both the resistor 180-1 and the resistor 180-2. This causes thermal energy to be generated in the heating area 105-2 shown in FIG. 1E, and the liquid in the pressure chamber 160 is heated by the thermal energy to generate bubbles. The liquid is ejected from the ejection port 140 through a series of processes, that is, generation, growth, and shrinkage of bubbles.

The amount (size) of droplets ejected from the ejection port 140 increases as the bubbles generated by thermal energy increase in size, that is, the thermal effect increases. The thermal effect of the heating area 105-2 is larger than that of the heating area 105-1. Thus, the amount of droplets ejected from the ejection port 140 by the second driving operation is larger than that of droplets ejected from the ejection port 140 by the first driving operation.

Varying the amount (size) of droplets ejected from the ejection port 140 by switching between the first and second driving operations depending on image data allows an image at a high gray level to be provided.

For the switching between the first and second driving operations, various methods can be employed. For example, the switching operation of the switching element 125 may be determined depending on whether the data stored in the latch circuit is at a high gray level.

Specifically, image data containing the gray levels of the individual pixels (for example, image data with 256 levels of gray) is held in the latch circuit via the shift resistor. In the case where the gray levels of data held in the latch circuit are equal to or greater than a threshold value, the driving pulse circuit 121-2 is selected by the switching element 125, and in the other case, the driving pulse circuit 121-1 is selected by the switching element 125. In this case, the amount of droplets is increased for an area with no density change (or an area with a little density change), and the amount of droplets is decreased for the other area to provide a high gray level image.

Another method is to determine whether to designate image data at a high gray level using user's input operation. If high gray level image data is designated, the driving pulse circuit 121-1 is selected by the switching element 125. If image data with no high gray level is designated, the driving pulse circuit 121-2 is selected by the switching element 125.

The liquid ejecting direction depends on the positional relationship between the center of the heating area and the ejection port 140. Therefore, if the positional relationship between the center of the heating area and the ejection port 140 changes during the switching between the first and second driving operations, the liquid ejecting direction changes. In this embodiment, since the center of the heating area 105-1 and the center of the heating area 105-2 substantially coincide with each other, the positional relationship between the center of the heating area and the ejection port 140 is maintained during the switching between the first and second driving operations. Thus, the liquid ejecting direction in the first driving operation is substantially the same as the liquid ejecting direction in the second driving operation.

Since the recording-element substrate of this embodiment has one heating resistance element for one ejection port, the size and cost can be decreased as compared with a configuration in which a plurality of heating resistance elements are provided for one ejection port. In addition, the amount of droplets ejected from one ejection port can be varied by changing the heating-area formed area depending on the electrode used in the heating resistance element, thus allowing providing a high-gray-level image. Thus, this embodiment provides the advantages of achieving high image quality and reducing an increase in the size and cost of the recording-element substrate.

Although the above description is made using the heating resistance element 150 having six electrodes as an example, the number of the electrodes of the heating resistance element 150 is not limited thereto. The number of the electrodes of the heating resistance element 150 is three or more. The number and combination of electrode pairs can also be changed as appropriate provided that the heating-area formed area can be changed by selectively using two or more electrodes.

Second Embodiment

Figure 3A:
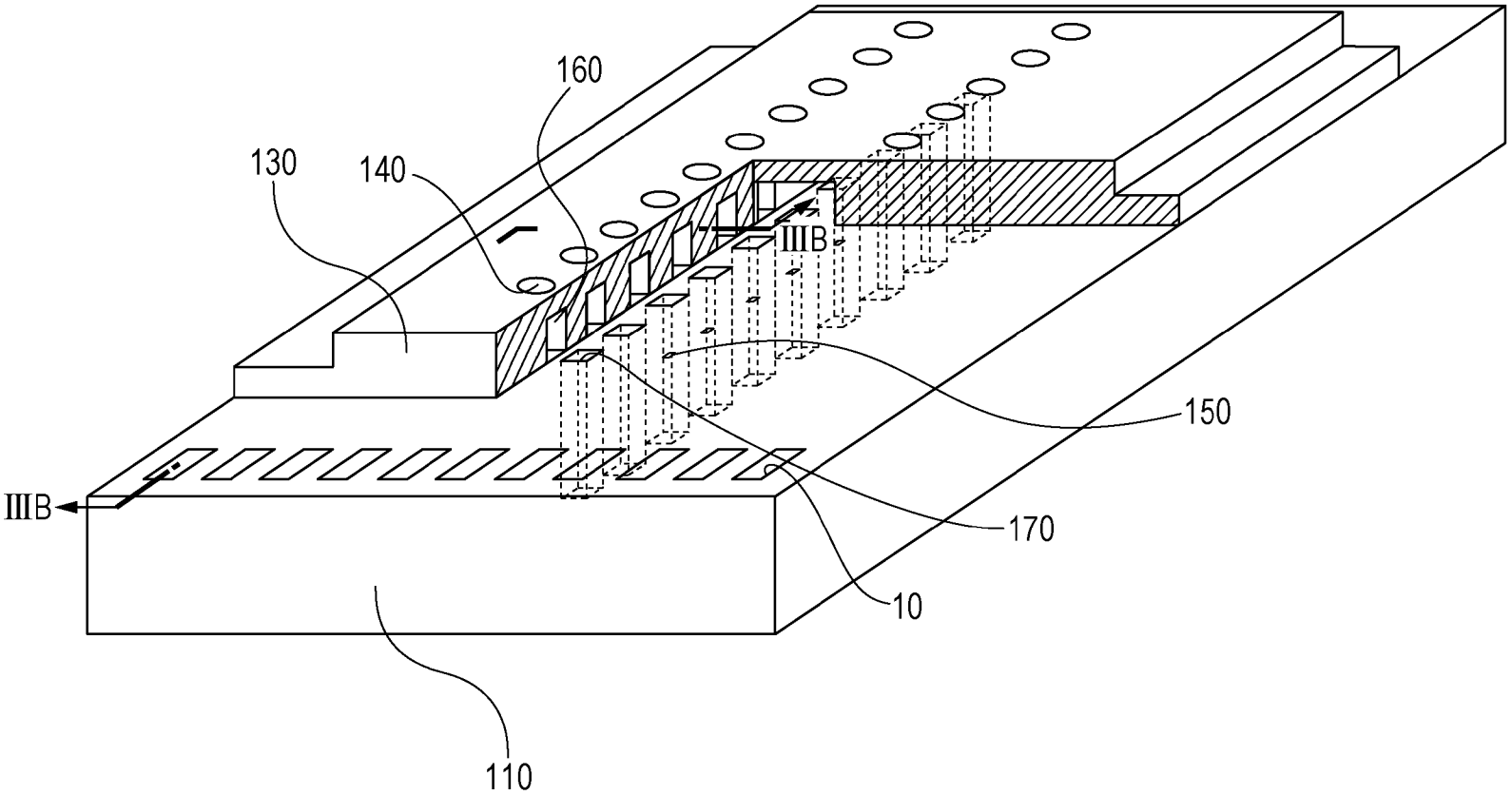
FIG. 3A is a schematic perspective view of a recording-element substrate according to a second embodiment of the present disclosure.
Figure 3B:
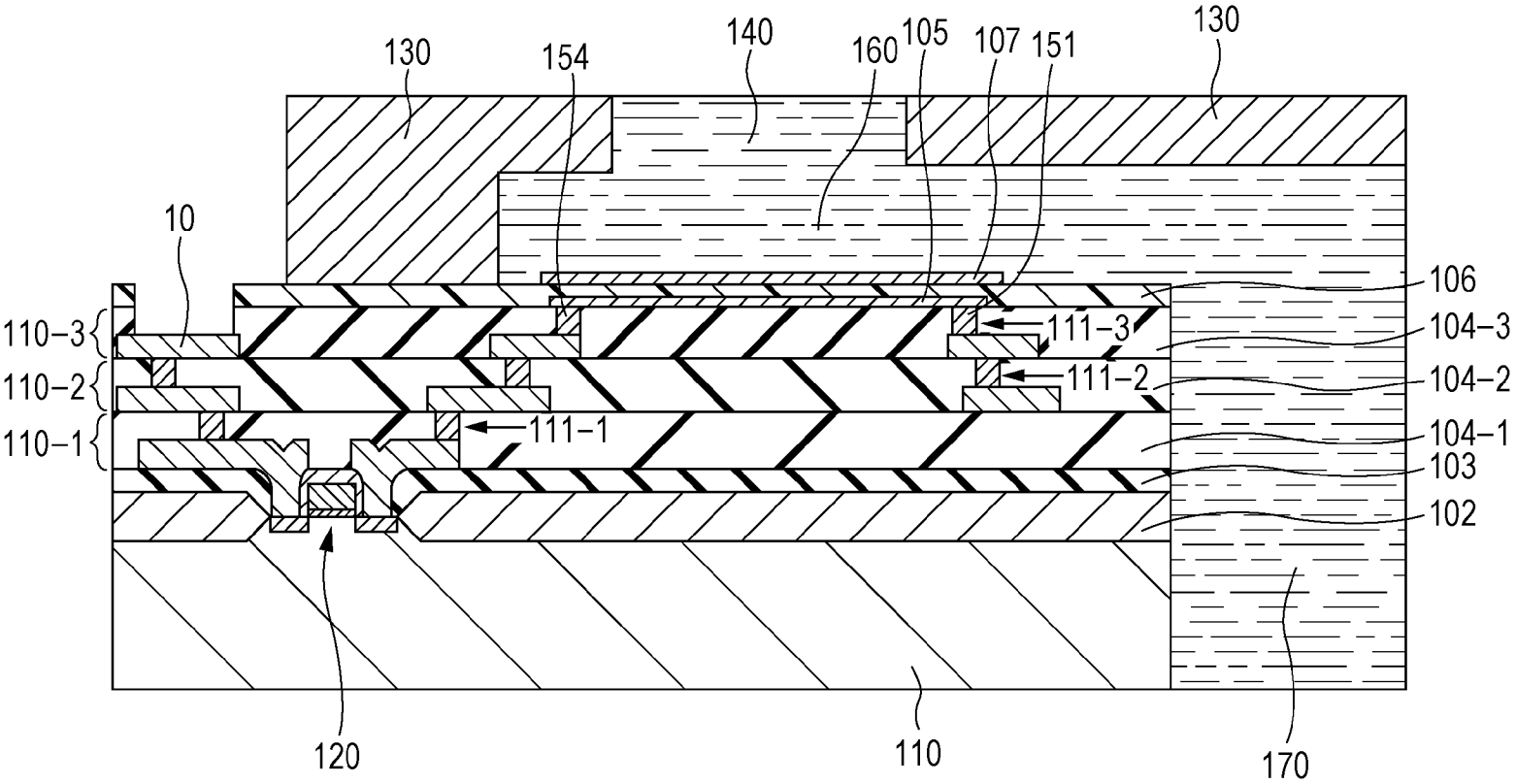
FIG. 3B is a schematic cross-sectional view showing a cross-section structure of the recording-element substrate shown in FIG. 3A.

FIG. 3A is a schematic perspective view of a recording-element substrate according to a second embodiment of the present disclosure. FIG. 3B is a schematic cross-sectional view showing a cross-section structure of the recording-element substrate shown in FIG. 3A taken along line IIIB-IIIB in a direction perpendicular to the substrate surface.

The recording-element substrate of this embodiment has the same configuration as that of the first embodiment except the heating resistance element 150.

In the first embodiment, the six electrodes 151-1 to 151-3 and 154-1 to 154-3 of the heating resistance element 150 are formed in the fourth wiring layer 110-4. In this embodiment, not the fourth wiring layer 110-4 but the third vias 111-3 are used to form seven electrodes 151 and seven electrodes 154 as electrodes of the heating resistance element 150.

A procedure for forming the third vias 111-3 is the same as that in the first embodiment, and a description thereof will be omitted.

The seven electrodes 151 and the seven electrodes 154 are formed of the third vias 111-3, and then the heating resistor layer 105 composed of TaSiN or WSiN is formed by the sputtering method. The heating resistor layer 105 is processed to a desired size by the lithography process and the dry etching process. The heating resistance element 150 includes the heating resistor layer 105 and 14 electrodes 151 and 154.

After the heating resistor layer 105 is processed, the passivation layer 106, the anti-cavitation layer 107, the terminals 10, the liquid supply ports 170, and the channel-formed member 130 are formed in sequence following the same procedure as that of the first embodiment. This embodiment may also has an adhesive layer made of a polyether amide resin or the like between the passivation layer 106 and the channel-formed member 130 to enhance the adhesiveness between the passivation layer 106 and the channel-formed member 130.

Figure 3C:
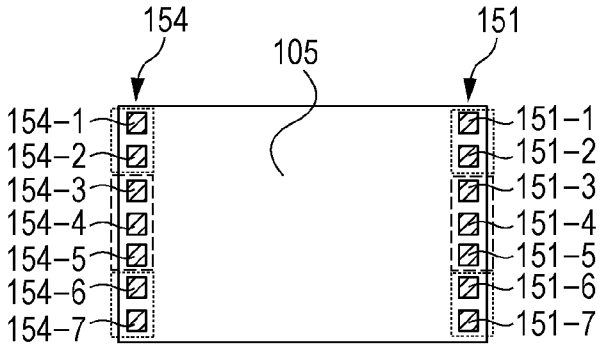
FIG. 3C is a schematic plan view of a heating resistance element provided on the recording-element substrate shown in FIG. 3A.

FIG. 3C is a schematic plan view of the heating resistance element 150.

As shown in FIG. 3C, the heating resistance element 150 includes one heating resistor layer 105, the electrode 151 including seven electrodes 151-1 to 151-7, and the electrode 154 including seven electrodes 154-1 to 154-7.

The electrodes 151-1 to 151-7 are formed at regular intervals on one of two opposing sides of the heating resistor layer 105, and the electrodes 154-1 to 154-7 are formed at regular intervals on the other side.

The electrode 151-1 and the electrode 154-1 constitute a pair of electrodes opposed to each other. Likewise, the electrodes 151-2 to 151-7 each constitute a pair with corresponding one of the electrodes 154-2 to 154-7, and the pairs are each opposed to each other.

The drive circuit for the heating resistance element 150 can selectively supply electric power to between the electrodes 151-1 to 151-7 and the electrodes 154-1 to 154-7 in response to a signal supplied via the terminal 10.

Figure 3D:
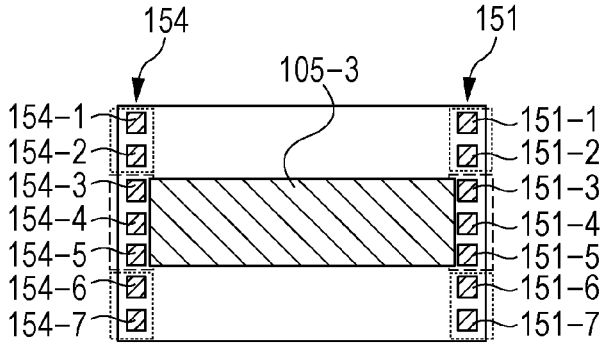
FIG. 3D is a schematic plan view showing an example of the driving state of the heating resistance element shown in FIG. 3C.

For example, as shown in FIG. 3D, the drive circuit can drive the heating resistance element 150 by supplying electric power to between the electrodes 151-3 to 151-5 and the electrodes 154-3 to 154-5. In this case, a heating area 105-3 is formed of the area between the electrodes 151-3 to 151-5 and the electrodes 154-3 to 154-5 of the heating resistor layer 105. The heating area 105-3 generates thermal energy for ejecting liquid.

Figure 3E:
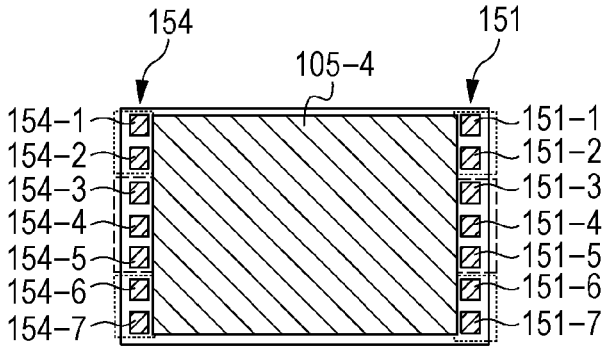
FIG. 3E is a schematic plan view showing another example of the driving state of the heating resistance element shown in FIG. 3C.

As shown in FIG. 3E, the drive circuit can drive the heating resistance element 150 by supplying electric power to between the electrodes 151-1 to 151-7 and the electrodes 154-1 to 154-7. In this case, the entire area of the heating resistor layer 105 forms a heating area 105-4. The heating area 105-4 generates thermal energy for ejecting liquid.

Circuit Configuration

Subsequently, the circuit configuration of the recording-element substrate will be described.

Figure 3F:
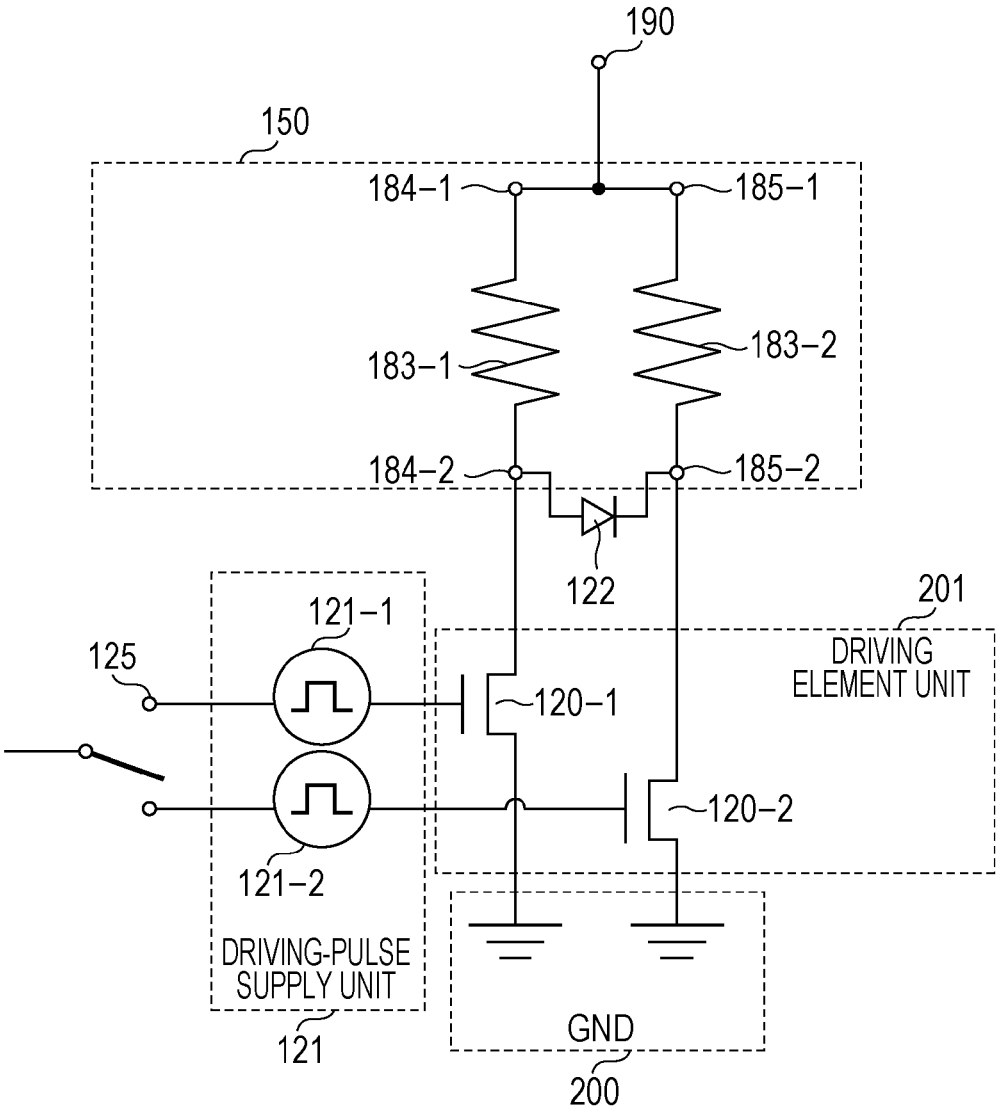
FIG. 3F is a circuit diagram showing an example of a circuit of the recording-element substrate shown in FIG. 3A.

FIG. 3F is a circuit diagram showing an example of a circuit of the recording-element substrate shown in FIG. 3A.

As shown in FIG. 3F, the circuit of the recording-element substrate includes the electrode 190, the heating resistance element 150, the diode 122, the driving element unit 201, the driving-pulse supply unit 121, and the switching element 125. Electric power is supplied to the electrode 190 via the terminal 10.

Since the components other than the heating resistance element 150 are the same as those shown in FIG. 2, the heating resistance element 150 will be described here, and descriptions of the other components will be omitted.

The heating resistance element 150 includes resistors 183-1 and 183-2 and electrodes 184-1, 184-2, 185-1, and 185-2.

One end of the resistor 183-1 is connected to the electrode 184-1, and the other end is connected the electrode 184-2. One end of the resistor 183-2 is connected to the electrode 185-1, and the other end is connected to the electrode 185-2. The electrode 184-1 and the electrode 185-1 are connected together, of which the connection line the electrode 190 is connected to.

The resistor 183-1 corresponds to a resistor formed of the area between the electrodes 151-3 to 151-5 and the electrodes 154-3 to 154-5 of the heating resistor layer 105 shown in FIG. 3C. In other words, the resistor 183-1 corresponds to the resistor in the heating area 105-3 shown in FIG. 3D. The electrode 184-1 corresponds to the electrode unit of the electrodes 151-3 to 151-5. The electrode 184-2 corresponds to the electrode unit of the electrodes 154-3 to 154-5.

The resistor 183-2 corresponds to a resistor formed of the area between the electrodes 151-1, 151-2, 151-6, and 151-7 and the electrodes 154-1, 154-2, 154-6, and 154-7 in the heating resistor layer 105 shown in FIG. 3C. The electrode 185-1 corresponds to the electrode unit of the electrode 151-1, 151-2, 151-6, and 151-7. The electrode 185-2 corresponds to the electrode unit of the electrode 154-1, 154-2, 154-6, and 154-7.

The driving element unit 201, the driving-pulse supply unit 121, and the switching element 125 constitute a drive circuit for driving the heating resistance element 150. Note that the drive circuit is given for mere illustration and can be changed in configuration as needed. For example, the switching element 125 may be provided outside the drive circuit. The drive circuit may include other devices and circuits for driving the heating resistance element 150.

Although not shown, the recording-element substrate includes, as circuits thereof, a shift resistor to which image data is serially input and a latch circuit that temporarily stores data output from the shift resistor. The switching element 125 selects one of the driving pulse circuits 121-1 and 121-2 on the basis of the data stored in the latch circuit. The driving pulse circuits 121-1 and 121-2 each output a driving pulse signal based on the data stored in the latch circuit. The pulse widths of the driving pulse signals output from the driving pulse circuits 121-1 and 121-2 are set as appropriate depending on the amounts (sizes) of droplets to be ejected. Although the pulse widths of the signals output from the driving pulse circuits 121-1 and 121-2 here are set to different values, this is not intended to limit the present disclosure. The pulse widths may be equal to each other. In this case, the number and pitch of vias that form the electrodes of the heating resistance element 150 and the widths and lengths of wiring layers (wiring resistors) are adjusted to make the amount (size) of droplets different.

First Driving Operation

The switching element 125 selects the driving pulse circuit 121-1. The driving element 120-1 operates in response to a driving pulse signal output from the driving pulse circuit 121-1, so that an electric current flows through the resistor 183-1. This causes thermal energy to be generated in the heating area 105-3 shown in FIG. 3D, and the liquid in the pressure chamber 160 is heated by the thermal energy to generate bubbles. The liquid is ejected from the ejection port 140 through a series of processes, that is, generation, growth, and shrinkage of bubbles.

Second Driving Operation

The switching element 125 selects the driving pulse circuit 121-2. The driving element 120-2 operates in response to a driving pulse signal output from the driving pulse circuit 122-1, so that current flows through both the resistor 183-1 and the resistor 183-2. This causes thermal energy to be generated in the heating area 105-4 shown in FIG. 3E, and the liquid in the pressure chamber 160 is heated by the thermal energy to generate bubbles. The liquid is ejected from the ejection port 140 through a series of processes, that is, generation, growth, and shrinkage of bubbles.

The thermal effect of the heating area 105-4 is larger than that of the heating area 105-3. Thus, the amount of droplets ejected from the ejection port 140 by the second driving operation is larger than that of droplets ejected from the ejection port 140 by the first driving operation. Varying the amount (size) of droplets by switching between the first and second driving operations allows an image at a high gray level to be provided.

The recording-element substrate of this embodiment also has one heating resistance element for one ejection port as in the first embodiment. Thus, the size and cost can be decreased as compared with a configuration in which a plurality of heating resistance elements are provided for one ejection port. In addition, this recording-element substrate is configured to vary the amount of droplets ejected from one ejection port, thus allowing providing a high-gray-level image. Thus, this embodiment provides the advantages of achieving high image quality and reducing an increase in the size and cost of the recording-element substrate.

In this embodiment, the electrodes of the heating resistance element 150 are formed not using the fourth wiring layer 110-4 but using the third vias 111-3. This allows a structure with less level difference than that of the first embodiment to be provided. This can decrease the thickness of the passivation layer 106 on the heating resistance element 150. In addition, the heating resistance element 150 can also be decreased in size, so that the recording-element substrate can be decreased in size (chip size).

Also in this embodiment, the center of the heating area 105-3 and the center of the heating area 105-4 substantially match, and thus, the positional relationship between the center of the heating area and the ejection port 140 is maintained during the switching between the first and second driving operations. Thus, the liquid ejecting direction in the first driving operation is substantially the same as the liquid ejecting direction in the second driving operation.

The number of the electrodes of the heating resistance element 150 is not limited to 14. The number of the electrodes of the heating resistance element 150 is three or more. The number and combination of electrode pairs can also be changed as appropriate provided that the heating-area formed area can be changed by selectively using two or more electrodes.

Third Embodiment

Figure 4A:
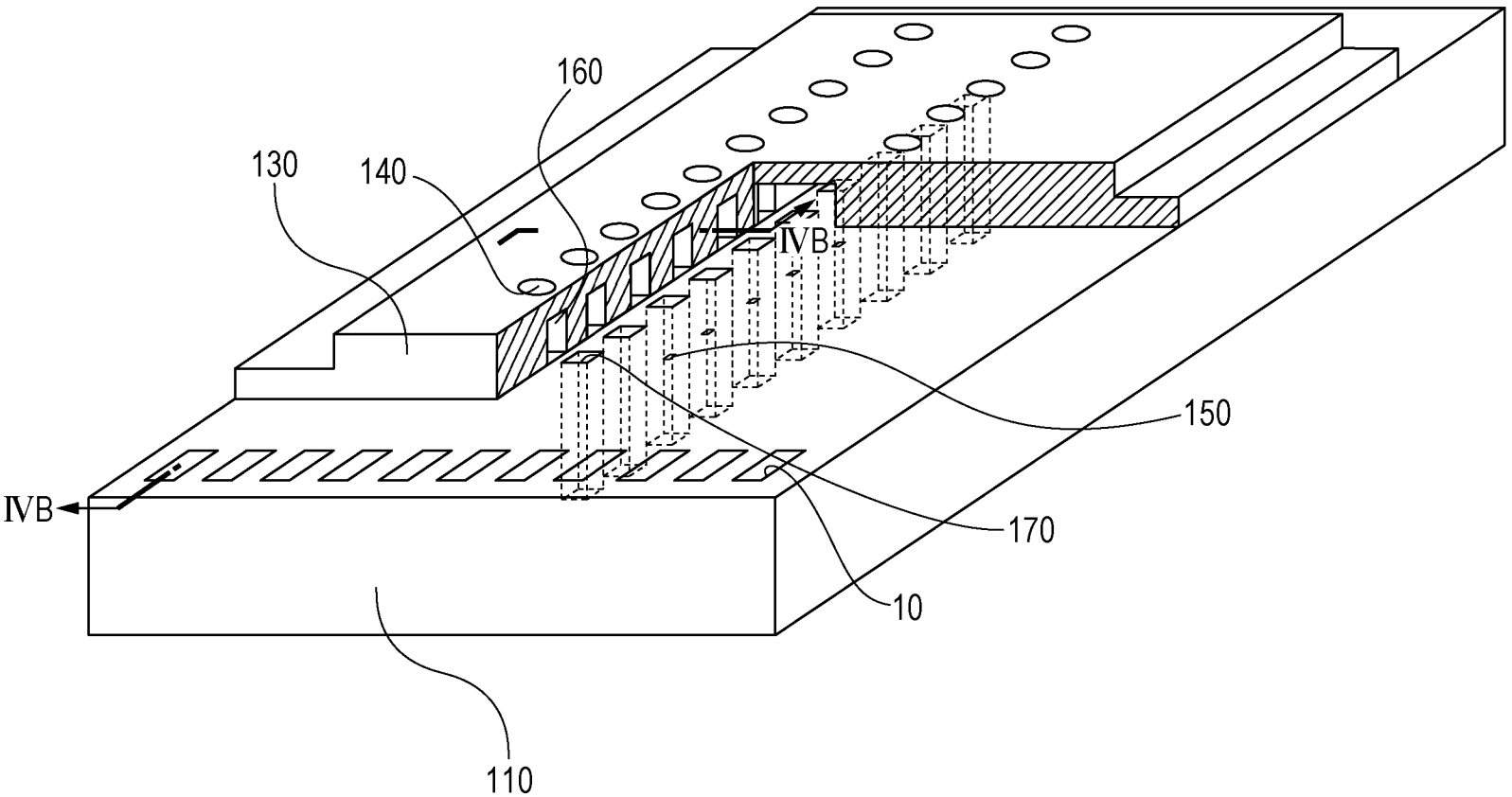
FIG. 4A is a schematic perspective view of a recording-element substrate according to a third embodiment of the present disclosure.
Figure 4B:
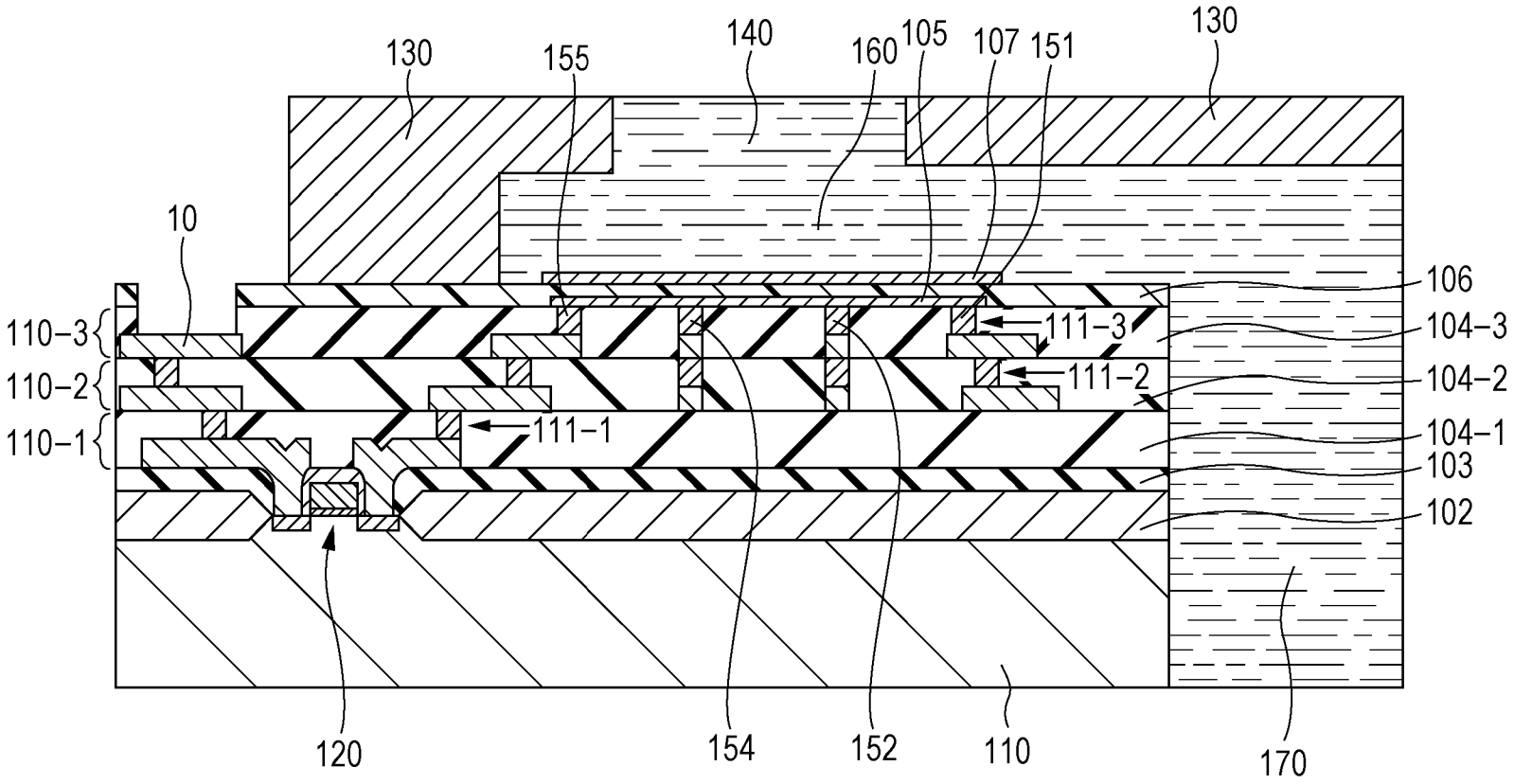
FIG. 4B is a schematic cross-sectional view showing a cross-section structure of the recording-element substrate shown in FIG. 4A.

FIG. 4A is a schematic perspective view of a recording-element substrate according to a third embodiment of the present disclosure. FIG. 4B is a schematic cross-sectional view showing a cross-section structure of the recording-element substrate shown in FIG. 4A taken along line IVB-IVB in a direction perpendicular to the substrate surface.

The recording-element substrate of this embodiment has the same configuration as that of the first embodiment except the heating resistance element 150 and the drive circuit.

In the first embodiment, the six electrodes 151-1 to 151-3 and 154-1 to 154-3 of the heating resistance element 150 are formed in the fourth wiring layer 110-4. In this embodiment, not the fourth wiring layer 110-4 but the third vias 111-3 are used to form seven electrodes 151, seven electrodes 155, three electrodes 152, and three electrodes 154 as electrodes of the heating resistance element 150.

A procedure for forming the third vias 111-3 is the same as that in the first embodiment, and a description thereof will be omitted.

The electrodes 151 to 155 are formed of the third vias 111-3, and then the heating resistor layer 105 composed of TaSiN or WSiN is formed by the sputtering method. The heating resistor layer 105 is processed to a desired size by the lithography process and the dry etching process. The heating resistance element 150 includes the heating resistor layer 105 and the electrodes 151 to 155.

After the heating resistor layer 105 is processed, the passivation layer 106, the anti-cavitation layer 107, the terminals 10, the liquid supply ports 170, and the channel-formed member 130 are formed in sequence following the same procedure as that of the first embodiment. This embodiment may also has an adhesive layer made of a polyether amide resin or the like between the passivation layer 106 and the channel-formed member 130 to enhance the adhesiveness between the passivation layer 106 and the channel-formed member 130.

Figure 4C:
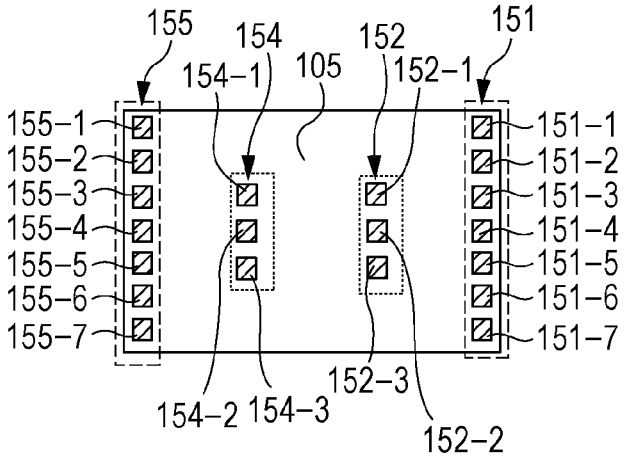
FIG. 4C is a schematic plan view of a heating resistance element provided on the recording-element substrate shown in FIG. 4A.

FIG. 4C is a schematic plan view of the heating resistance element 150.

As shown in FIG. 4C, the heating resistance element 150 includes one heating resistor layer 105, and 20 electrodes 151-1 to 151-7, 152-1 to 152-3, 154-1 to 154-3, and 155-1 to 155-7.

The electrodes 151-1 to 151-7 are formed at regular intervals on one of two opposing sides of the heating resistor layer 105, and the electrodes 155-1 to 155-7 are formed at regular intervals on the other side.

The electrodes 152-1 and 154-1 are provided at a predetermined interval between the electrode 151-3 and the electrode 155-3 in the heating resistor layer 105. The electrode 152-1 is disposed adjacent the electrode 151-3, and the electrode 154-1 is disposed adjacent the electrode 155-3. The center of the area between the electrodes 151-3 and 155-3 and the center of the area between the electrodes 152-1 and 154-1 substantially match.

The electrodes 152-2 and 154-2 are provided at a predetermined interval between the electrode 151-4 and the electrode 155-4 in the heating resistor layer 105. The electrode 152-2 is disposed adjacent the electrode 151-4, and the electrode 154-2 is disposed adjacent the electrode 155-4. The center of the area between the electrodes 151-4 and 155-4 and the center of the area between the electrodes 152-2 and 154-2 substantially coincide with each other.

The electrodes 152-3 and 154-3 are provided at a predetermined interval between the electrode 151-5 and the electrode 155-5 in the heating resistor layer 105. The electrode 152-3 is disposed adjacent the electrode 151-5, and the electrode 154-3 is disposed adjacent the electrode 155-5. The center of the area between the electrodes 151-5 and 155-5 and the center of the area between the electrodes 152-3 and 154-3 substantially coincide with each other.

The drive circuit for the heating resistance element 150 can selectively supply electric power between the electrodes 152-1 to 152-3 and the electrodes 154-1 to 154-3 and between the electrodes 151-1 to 151-7 and the electrodes 155-1 to 155-7 in response to a signal supplied via the terminal 10.

Figure 4D:
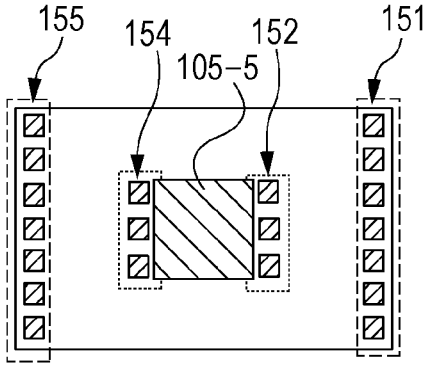
FIG. 4D is a schematic plan view showing an example of the driving state of the heating resistance element shown in FIG. 4C.

For example, as shown in FIG. 4D, the drive circuit can drive the heating resistance element 150 by supplying electric power to between the electrodes 152-1 to 152-3 and the electrodes 154-1 to 154-3. In this case, a heating area 105-5 is formed of the area between the electrodes 152-1 to 152-3 and the electrodes 154-1 to 154-3 of the heating resistor layer 105. The heating area 105-5 generates thermal energy for ejecting liquid.

Figure 4E:
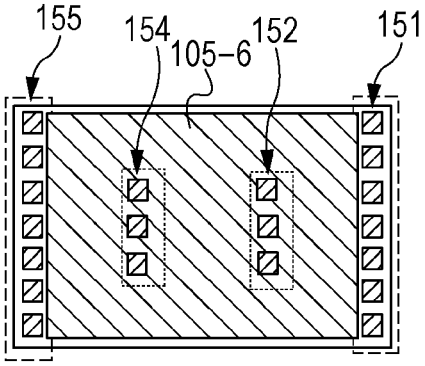
FIG. 4E is a schematic plan view showing another example of the driving state of the heating resistance element shown in FIG. 4C.

As shown in FIG. 4E, the drive circuit can drive the heating resistance element 150 by supplying electric power to between the electrodes 151-1 to 151-7 and the electrodes 155-1 to 155-7. In this case, the entire area of the heating resistor layer 105 forms a heating area 105-6. The heating area 105-6 generates thermal energy for ejecting liquid.

Circuit Configuration

Next, the circuit configuration of the recording-element substrate will be described.

Figure 5:
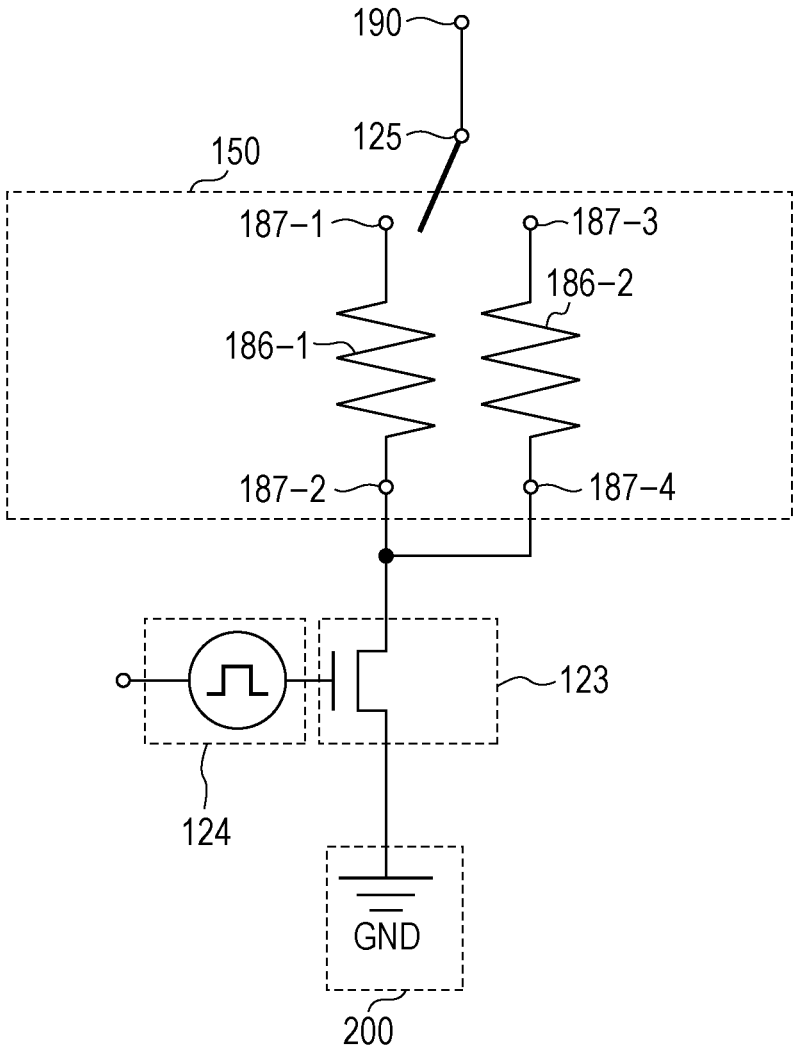
FIG. 5 is a circuit diagram showing an example of a circuit of the recording-element substrate shown in FIG. 4A.

FIG. 5 is a circuit diagram showing an example of a circuit of the recording-element substrate shown in FIG. 4A.

As shown in FIG. 5, the circuit of the recording-element substrate includes the electrode 190, the heating resistance element 150, a driving element 123, a driving pulse circuit 124, and the switching element 125. Electric power is supplied to the electrode 190 via the terminal 10.

The heating resistance element 150 includes resistors 186-1 and 186-2 and electrodes 187-1 to 187-4. One end of the resistor 186-1 is connected to the electrode 187-1, and the other end is connected to the electrode 187-2. One end of the resistor 186-2 is connected to the electrode 187-3, and the other end is connected to the electrode 187-4.

The resistor 186-1 corresponds to a resistor formed of the area between the electrodes 151-1 to 151-7 and the electrodes 155-1 to 155-7 of the heating resistor layer 105 shown in FIG. 4C. In other words, the resistor 186-1 corresponds to the resistor in the heating area 105-6 shown in FIG. 4E. The electrode 187-1 corresponds to the electrode unit of the electrodes 151-1 to 151-7. The electrode 187-2 corresponds to the electrode unit of the electrodes 155-1 to 155-7.

The resistor 186-2 corresponds to a resistor formed of the area between the electrodes 152-1 to 152-3 and the electrodes 154-1 to 154-3 of the heating resistor layer 105 shown in FIG. 4C. In other words, the resistor 186-2 corresponds to the resistor in the heating area 105-5 shown in FIG. 4D. The electrode 187-3 corresponds to the electrode unit of the electrodes 152-1 to 152-3. The electrode 187-4 corresponds to the electrode unit of the electrodes 154-1 to 154-3.

The switching element 125 selectively supplies electric power supplied from the electrode 190 to one of the electrode 187-1 and 187-3.

The driving element 123 is a transistor or the like, of which one of the source and the drain is connected to the GND 200, and the other is connected to the electrodes 187-2 and 187-4. The GND 200 is grounded via the terminal 10.

The driving pulse circuit 124 outputs a driving pulse signal. The driving pulse signal output from the driving pulse circuit 124 is supplied to the gate terminal of the driving element 123.

The driving element 123, the driving pulse circuit 124, and the switching element 125 constitute a drive circuit for driving the heating resistance element 150. Note that the drive circuit is given for mere illustration and can be changed in configuration as needed. For example, the switching element 125 may be provided outside the drive circuit. The drive circuit may include other devices and circuits for driving the heating resistance element 150.

Although not shown, the recording-element substrate includes, as circuits thereof, a shift resistor to which image data is serially input and a latch circuit that temporarily stores data output from the shift resistor. The switching element 125 selects one of the resistors 186-1 and 186-2 on the basis of the data stored in the latch circuit. The driving pulse circuit 124 outputs a driving pulse signal based on the data stored in the latch circuit. The use of the data stored in the latch circuit allows the switching operation of the switching element 125 and the operation of the driving pulse circuit 124 to be synchronized.

Since the driving element 123 operates on the basis of the driving pulse signal output from the driving pulse circuit 124, an electric current flows through a resistor selected by the switching element 125.

In this embodiment, the number and pitch of vias that form the electrodes of the heating resistance element 150 and the widths and lengths of wiring layers (wiring resistors) are adjusted so as to be able to eject different amounts (sizes) of droplets with the same pulse width.

For example, the sheet resistance of the heating resistor layer 105 is 200Ω per square. The interval between the electrodes 151-1 to 151-7 that constitute the electrode 187-1 is 35 μm, the width is 35 μm, and the wiring resistance is 40Ω. The electrodes 155-1 to 155-7 that constitute the electrode 187-2 have the same configuration as that of the electrode 187-1.

The interval between the electrodes 152-1 to 152-3 that constitute the electrode 187-3 is 28 μm, the width is 25 μm, and the wiring resistance is 120Ω. The electrodes 154-1 to 154-3 that constitute the electrode 187-4 have the same configuration as that of the electrode 187-3.

First Driving Operation

The switching element 125 selects the resistor 186-1. The driving element 123 operates in response to a driving pulse signal output from the driving pulse circuit 124, so that an electric current flows through the resistor 186-1. This causes thermal energy to be generated in the heating area 105-6 shown in FIG. 4E, and the liquid in the pressure chamber 160 is heated by the thermal energy to generate bubbles. The liquid is ejected from the ejection port 140 through a series of processes, that is, generation, growth, and shrinkage of bubbles.

Second Driving Operation

The switching element 125 selects the resistor 186-2. The driving element 123 operates in response to a driving pulse signal output from the driving pulse circuit 124, so that an electric current flows through the resistor 186-2. This causes thermal energy to be generated in the heating area 105-5 shown in FIG. 4D, and the liquid in the pressure chamber 160 is heated by the thermal energy to generate bubbles. The liquid is ejected from the ejection port 140 through a series of processes, that is, generation, growth, and shrinkage of bubbles.

The thermal effect of the heating area 105-6 is larger than that of the heating area 105-5. Thus, the amount of droplets ejected from the ejection port 140 by the first driving operation is larger than that of droplets ejected from the ejection port 140 by the second driving operation.

Varying the amount (size) of droplets by switching between the first and second driving operations allows an image at a high gray level to be provided.

The recording-element substrate of this embodiment also has one heating resistance element for one ejection port as in the first embodiment. Thus, the size and cost can be decreased as compared with a configuration in which a plurality of heating resistance elements are provided for one ejection port. In addition, this recording-element substrate is configured to vary the amount of droplets ejected from one ejection port, thus allowing providing a high-gray-level image. Thus, this embodiment provides the advantages of achieving high image quality and reducing an increase in the size and cost of the recording-element substrate.

Since the electrodes of the heating resistance element 150 are formed not using the fourth wiring layer 110-4 but using the third vias 111-3, a structure with less level difference than that of the first embodiment can be provided. This can decrease the thickness of the passivation layer 106 on the heating resistance element 150. In addition, the heating resistance element 150 can also be decreased in size, so that the recording-element substrate can be decreased in size (chip size).

Furthermore, since the center of the heating area 105-5 and the center of the heating area 105-6 substantially match, the positional relationship between the center of the heating area and the ejection port 140 is maintained during the switching between the first and second driving operations. Thus, the liquid ejecting direction in the first driving operation is substantially the same as the liquid ejecting direction in the second driving operation.

The number of the electrodes of the heating resistance element 150 is not limited to 20. The number of the electrodes of the heating resistance element 150 is three or more. The number and combination of electrode pairs can also be changed as appropriate provided that the heating-area formed area can be changed by selectively using two or more electrodes.

To minimize heat that escapes through the vias and wiring lines, the third wiring layer 110-3 and the third vias 111-3 that constitute the electrodes 152-1 to 152-3 and 154-1 to 154-3 may be as thin as possible. For example, the third wiring layer 110-3 and the third vias 111-3 may be thinner than the second wiring layer 110-2 and the second vias 111-2.

Instead of the circuit shown in FIG. 5, a circuit that operates at different pulses, as shown in FIG. 2 or FIG. 3F, may be used in this embodiment. For example, with the circuit shown in FIG. 2, the electrodes 181-1, 181-2, 182-1, and 182-2 are replaced with the electrodes 187-1, 187-2, 187-3, and 187-4, and the resistors 180-1 and 180-2 are replaced with the resistors 186-1 and 186-2, respectively. The circuit operation is the same as that of the first embodiment.

Fourth Embodiment

Reference Example

Figure 6A:
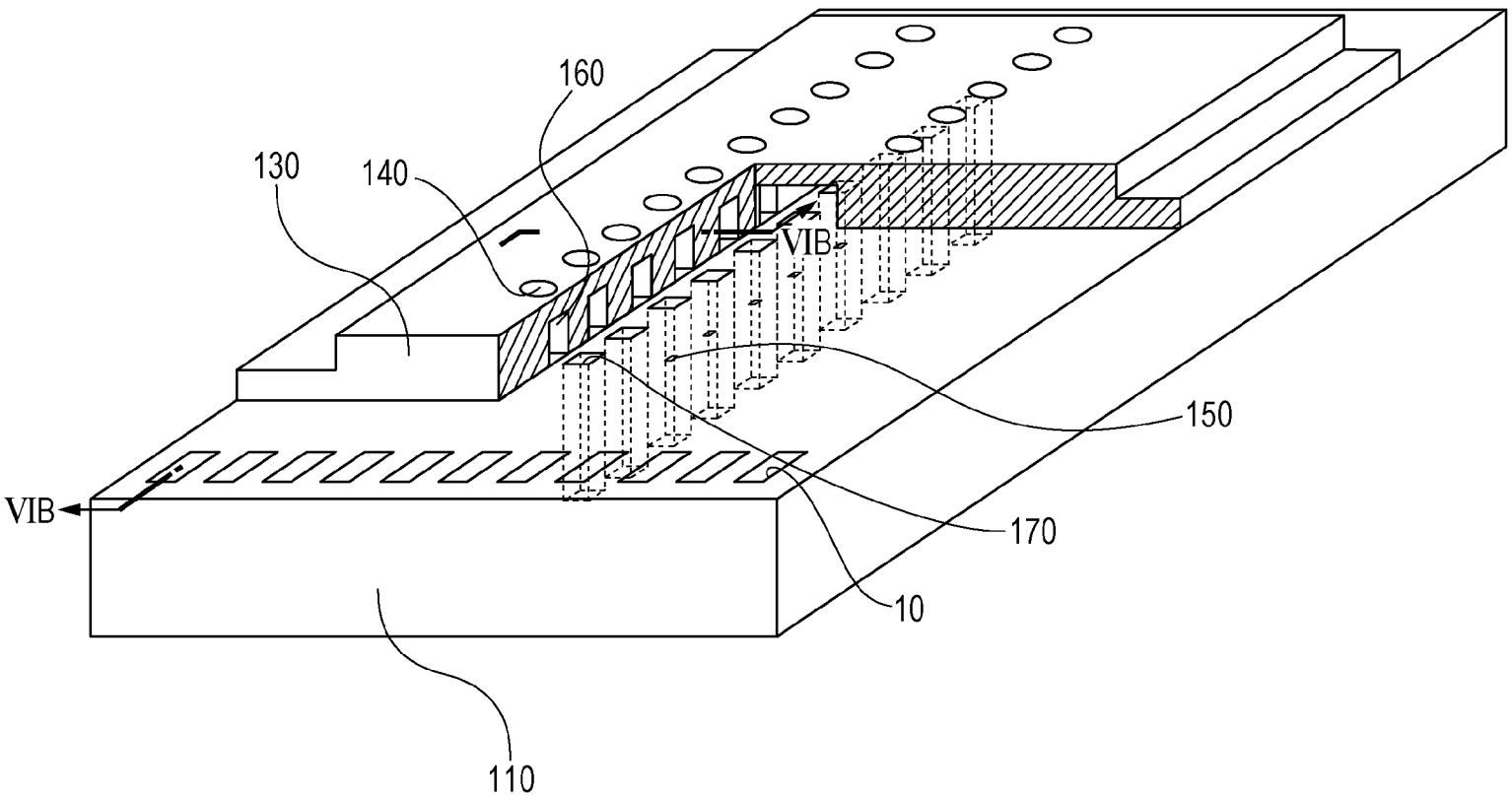
FIG. 6A is a schematic perspective view of a recording-element substrate according to a fourth embodiment of the present disclosure.
Figure 6B:
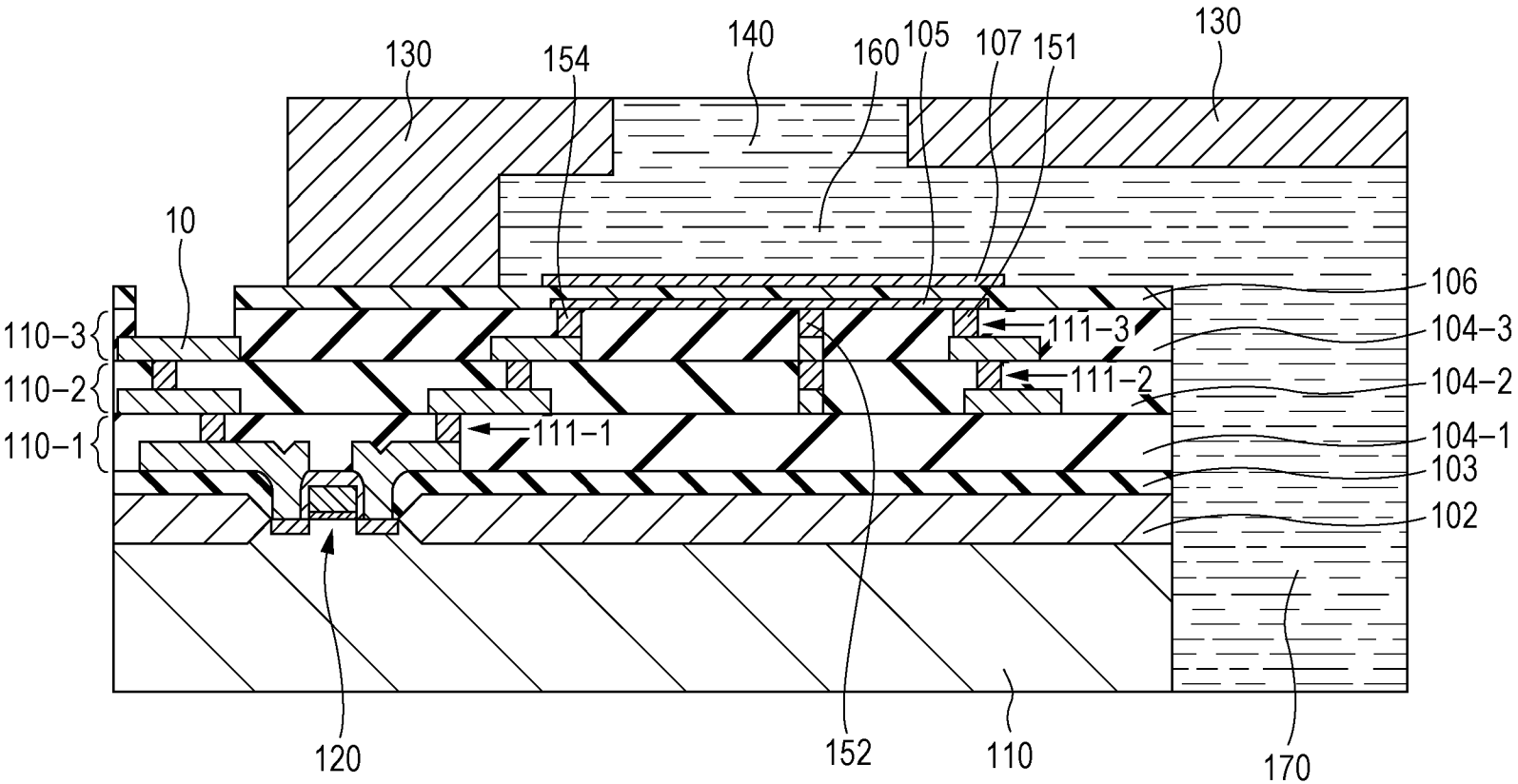
FIG. 6B is a schematic cross-sectional view showing a cross-section structure of the recording-element substrate shown in FIG. 6A.

FIG. 6A is a schematic perspective view of a recording-element substrate according to a fourth embodiment of the present disclosure. FIG. 6B is a schematic cross-sectional view showing a cross-section structure of the recording-element substrate shown in FIG. 6A taken along line VIB-VIB in a direction perpendicular to the substrate surface.

The recording-element substrate of this embodiment has the same configuration as that of the first embodiment except the heating resistance element 150 and the drive circuit.

In the first embodiment, the six electrodes 151-1 to 151-3 and 154-1 to 154-3 of the heating resistance element 150 are formed in the fourth wiring layer 110-4. In this embodiment, not the fourth wiring layer 110-4 but the third vias 111-3 are used to form seven electrodes 151, seven electrodes 154, and three electrodes 152 as electrodes of the heating resistance element 150.

A procedure for forming the third vias 111-3 is the same as that in the first embodiment, and a description thereof will be omitted.

The electrodes 151, 152, and 154 are formed of the third vias 111-3, and then the heating resistor layer 105 composed of TaSiN or WSiN is formed by the sputtering method. The heating resistor layer 105 is processed to a desired size by the lithography process and the dry etching process. The heating resistance element 150 includes the heating resistor layer 105 and the electrodes 151, 152, and 154.

After the heating resistor layer 105 is processed, the passivation layer 106, the anti-cavitation layer 107, the terminals 10, the liquid supply ports 170, and the channel-formed member 130 are formed in sequence following the same procedure as that of the first embodiment. This embodiment may also has an adhesive layer made of a polyether amide resin or the like between the passivation layer 106 and the channel-formed member 130 to enhance the adhesiveness between the passivation layer 106 and the channel-formed member 130.

Figure 6C:
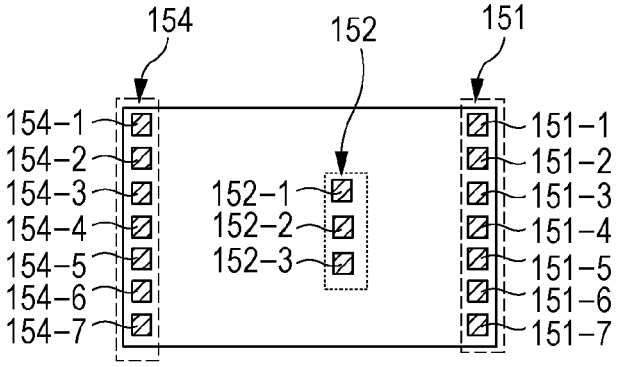
FIG. 6C is a schematic plan view of a heating resistance element provided on the recording-element substrate shown in FIG. 6A.

FIG. 6C is a schematic plan view of the heating resistance element 150.

As shown in FIG. 6C, the heating resistance element 150 includes one heating resistor layer 105 and 17 electrodes 151-1 to 151-7, 152-1 to 152-3, and 154-1 to 154-7.

The electrodes 151-1 to 151-7 are formed at regular intervals on one of two opposing sides of the heating resistor layer 105, and the electrodes 154-1 to 154-7 are formed at regular intervals on the other side. The electrodes 151-1 to 151-7 and the electrodes 154-1 to 154-7 are opposed to each other.

The electrode 152-1 is disposed between the electrode 151-3 and the electrode 154-3. The interval between the electrode 152-1 and the electrode 151-3 is shorter than the interval between the electrode 152-1 and the electrode 154-3. The electrode 152-2 is disposed between the electrode 151-4 and the electrode 154-4. The interval between the electrode 152-2 and the electrode 151-4 is shorter than the interval between the electrode 152-2 and the electrode 154-4. The electrode 152-3 is disposed between the electrode 151-5 and the electrode 154-5. The interval between the electrode 152-3 and the electrode 151-5 is shorter than the interval between the electrode 152-3 and the electrode 154-5. The drive circuit for the heating resistance element 150 can selectively supply electric power between the electrodes 152-1 to 152-3 and the electrodes 154-3 to 154-5 and between the electrodes 151-1 to 151-7 and the electrodes 154-1 to 154-7 in response to a signal supplied via the terminal 10.

Figure 6D:
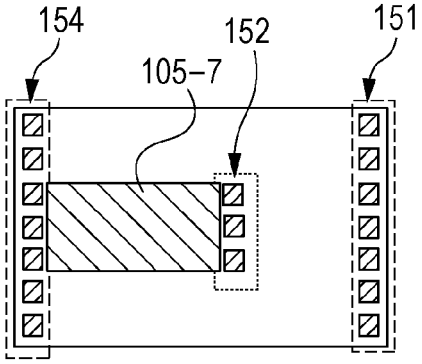
FIG. 6D is a schematic plan view showing an example of the driving state of the heating resistance element shown in FIG. 6C.

For example, as shown in FIG. 6D, the drive circuit can drive the heating resistance element 150 by supplying electric power to between the electrodes 152-1 to 152-3 and the electrodes 154-3 to 154-5. In this case, a heating area 105-7 is formed of the area between the electrodes 152-1 to 152-3 and the electrodes 154-3 to 154-5 of the heating resistor layer 105. The heating area 105-7 generates thermal energy for ejecting liquid.

Figure 6E:
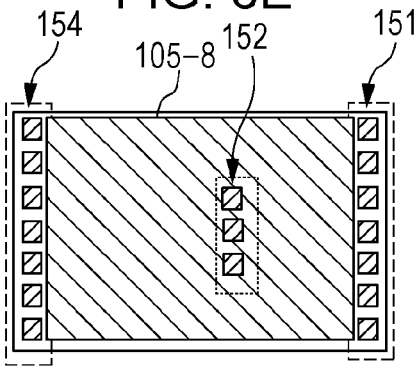
FIG. 6E is a schematic plan view showing another example of the driving state of the heating resistance element shown in FIG. 6C.

As shown in FIG. 6E, the drive circuit can drive the heating resistance element 150 by supplying electric power to between the electrodes 151-1 to 151-7 and the electrodes 154-1 to 154-7. In this case, the entire area of the heating resistor layer 105 forms a heating area 105-8. The heating area 105-8 generates thermal energy for ejecting liquid.

Circuit Configuration

Next, the circuit configuration of the recording-element substrate will be described.

Figure 7:
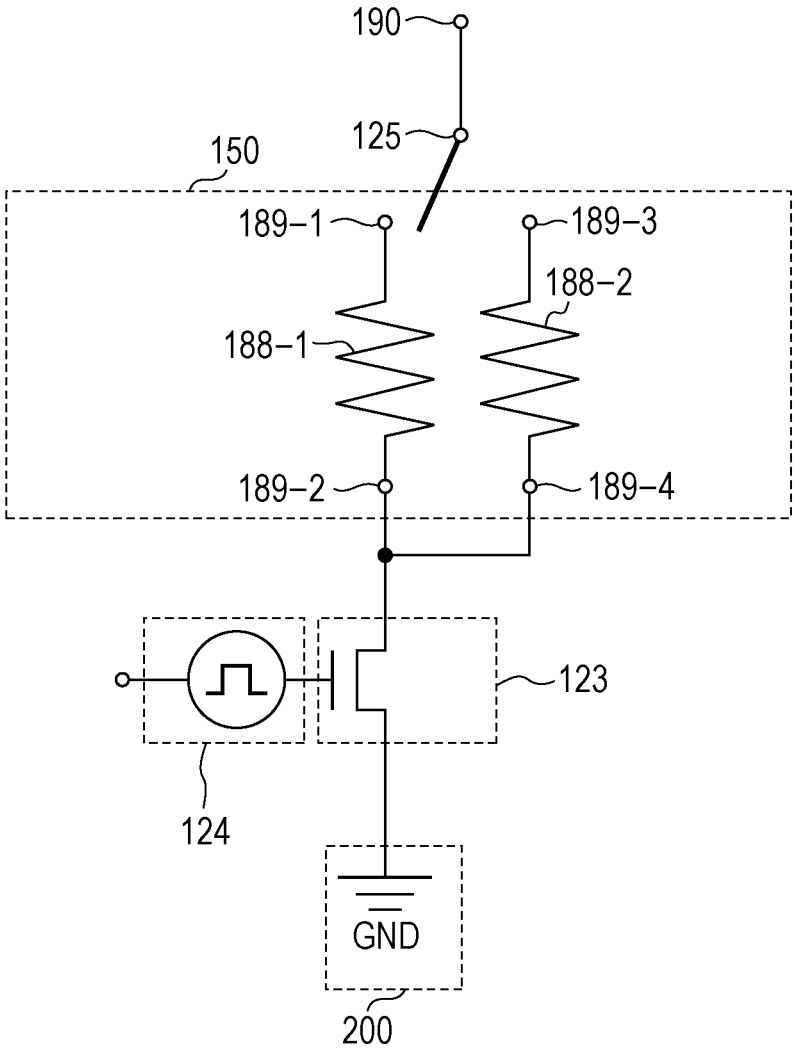
FIG. 7 is a circuit diagram illustrating an example of a circuit of the recording-element substrate shown in FIG. 6A.

FIG. 7 is a circuit diagram illustrating an example of a circuit of the recording-element substrate shown in FIG. 6A.

As shown in FIG. 7, the circuit of the recording-element substrate includes the electrode 190, the heating resistance element 150, the driving element 123, the driving pulse circuit 124, and the switching element 125. Electric power is supplied to the electrode 190 via the terminal 10.

The heating resistance element 150 includes resistors 188-1 and 188-2 and electrodes 189-1 to 189-4.

One end of the resistor 188-1 is connected to the electrode 189-1, and the other end is connected to the electrode 189-2. One end of the resistor 188-2 is connected to the electrode 189-3, and the other end is connected to the electrode 189-4.

The resistor 188-1 corresponds to a resistor formed of the area between the electrodes 151-1 to 151-7 and the electrodes 154-1 to 154-7 of the heating resistor layer 105 shown in FIG. 6C. In other words, the resistor 188-1 corresponds to the resistor in the heating area 105-8 shown in FIG. 6E. The electrode 189-1 corresponds to the electrode unit of the electrodes 151-1 to 151-7. The electrode 189-2 corresponds to the electrode unit of the electrodes 154-1 to 154-7.

The resistor 188-2 corresponds to a resistor formed of the area between the electrodes 152-1 to 152-3 and the electrodes 154-3 to 154-5 of the heating resistor layer 105 shown in FIG. 6C. In other words, the resistor 188-2 corresponds to the resistor in the heating area 105-7 shown in FIG. 6D. The electrode 189-3 corresponds to the electrode unit of the electrodes 152-1 to 152-3. The electrode 189-4 corresponds to the electrode unit of the electrodes 154-3 to 154-5.

The switching element 125 selectively supplies electric power supplied from the electrode 190 to one of the electrodes 189-1 and 189-3.

The driving element 123 is a transistor or the like, of which one of the source and the drain is connected to the GND 200, and the other is connected to the electrodes 189-2 and 189-4. The GND 200 is grounded via the terminal 10.

The driving pulse circuit 124 outputs a driving pulse signal. The driving pulse signal output from the driving pulse circuit 124 is supplied to the gate terminal of the driving element 123.

The driving element 123, the driving pulse circuit 124, and the switching element 125 constitute a drive circuit for driving the heating resistance element 150. Note that the drive circuit is given for mere illustration and can be changed in configuration as needed. For example, the switching element 125 may be provided outside the drive circuit. The drive circuit may include other devices and circuits for driving the heating resistance element 150.

Although not shown, the recording-element substrate includes, as circuits thereof, a shift resistor to which image data is serially input and a latch circuit that temporarily stores data output from the shift resistor. The switching element 125 selects one of the resistors 188-1 and 188-2 on the basis of the data stored in the latch circuit. The driving pulse circuit 124 outputs a driving pulse signal based on the data stored in the latch circuit. The use of the data stored in the latch circuit allows the switching operation of the switching element 125 and the operation of the driving pulse circuit 124 to be synchronized.

Since the driving element 123 operates on the basis of the driving pulse signal output from the driving pulse circuit 124, an electric current flows through a resistor selected by the switching element 125.

Also in this embodiment, the number and pitch of vias that form the electrodes of the heating resistance element 150 and the widths and lengths of wiring layers (wiring resistors) are adjusted so as to be able to eject different amounts (sizes) of droplets with the same pulse width as in the third embodiment.

For example, the sheet resistance of the heating resistor layer 105 is 200Ω per square. The interval between the electrodes 151-1 to 151-7 is 35 μm, the width is 35 μm, and the wiring resistance is 40Ω. The electrodes 154-1 to 154-7 have the same configuration as that of the electrodes 151-1 to 151-7. The interval between the electrodes 152-1 to 152-3 is 28 μm, the width is 25 μm, and the wiring resistance is 120 Ω.

First Driving Operation

The switching element 125 selects the resistor 188-1. The driving element 123 operates in response to a driving pulse signal output from the driving pulse circuit 124, so that an electric current flows through the resistor 188-1. This causes thermal energy to be generated in the heating area 105-8 shown in FIG. 6E, and the liquid in the pressure chamber 160 is heated by the thermal energy to generate bubbles. The liquid is ejected from the ejection port 140 through a series of processes, that is, generation, growth, and shrinkage of bubbles.

Second Driving Operation

The switching element 125 selects the resistor 188-2. The driving element 123 operates in response to a driving pulse signal output from the driving pulse circuit 124, so that an electric current flows through the resistor 188-2. This causes thermal energy to be generated in the heating area 105-7 shown in FIG. 6D, and the liquid in the pressure chamber 160 is heated by the thermal energy to generate bubbles. The liquid is ejected from the ejection port 140 through a series of processes, that is, generation, growth, and shrinkage of bubbles.

The thermal effect of the heating area 105-8 is larger than that of the heating area 105-7. Thus, the amount of droplets ejected from the ejection port 140 by the first driving operation is larger than that of droplets ejected from the ejection port 140 by the second driving operation.

Varying the amount (size) of droplets by switching between the first and second driving operations depending on image data allows an image at a high gray level to be provided.

The recording-element substrate of this embodiment also has one heating resistance element for one ejection port as in the first embodiment. Thus, the size and cost can be decreased as compared with a configuration in which a plurality of heating resistance elements are provided for one ejection port. In addition, this recording-element substrate is configured to vary the amount of droplets ejected from one ejection port, thus allowing providing a high-gray-level image. Thus, this embodiment provides the advantages of achieving high image quality and reducing an increase in the size and cost of the recording-element substrate.

Since, also in this embodiment, the electrodes of the heating resistance element 150 are formed not using the fourth wiring layer 110-4 but using the third vias 111-3, a structure with less level difference than that of the first embodiment can be provided. This can decrease the thickness of the passivation layer 106 on the heating resistance element 150. In addition, the heating resistance element 150 can also be decreased in size, so that the recording-element substrate can be decreased in size (chip size).

The center of the heating area 105-7 and the center of the heating area 105-8 do not coincide with each other.

Fifth Embodiment

Figure 8A:
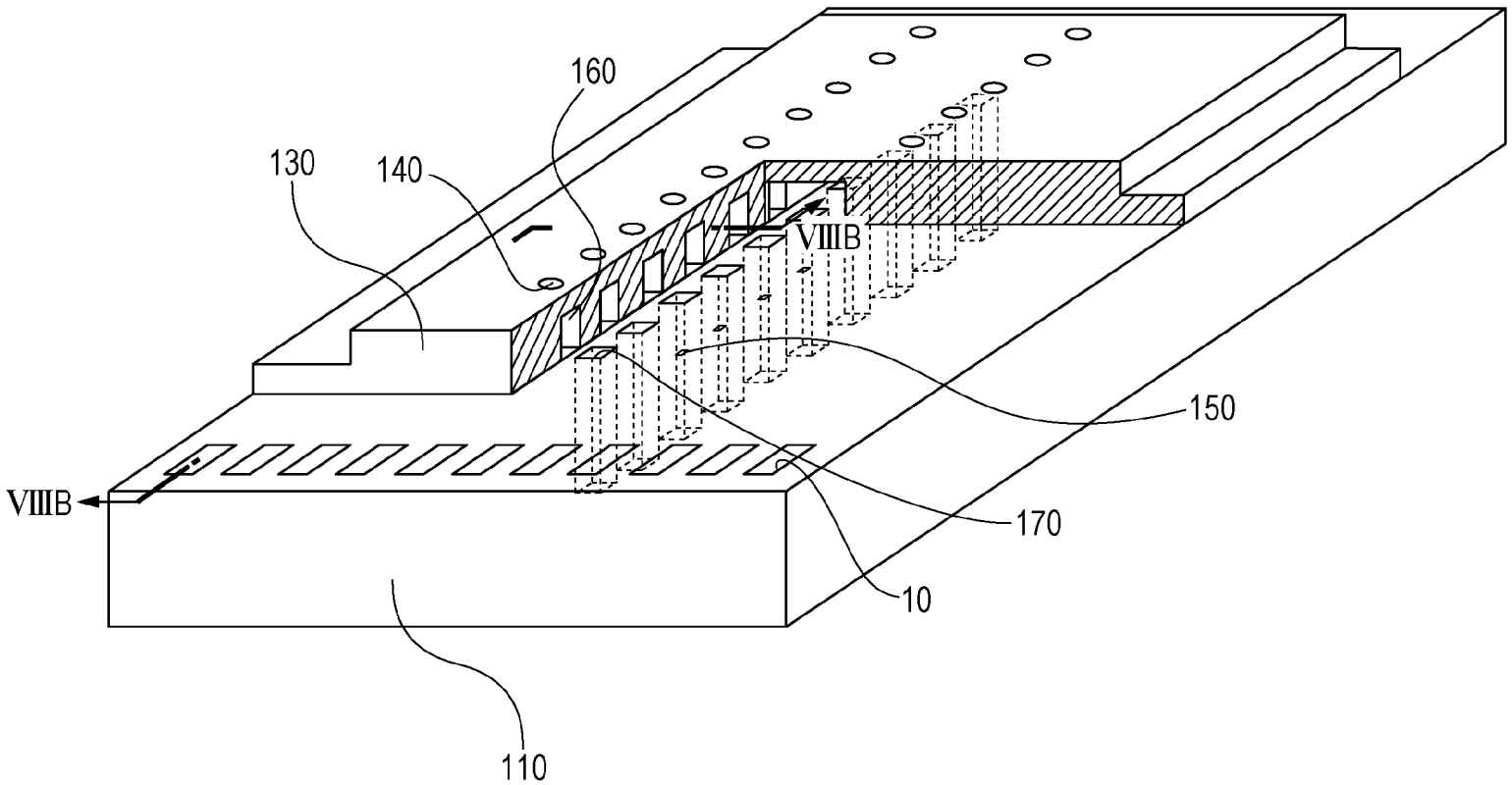
FIG. 8A is a schematic perspective view of a recording-element substrate according to a fifth embodiment of the present disclosure.
Figure 8B:
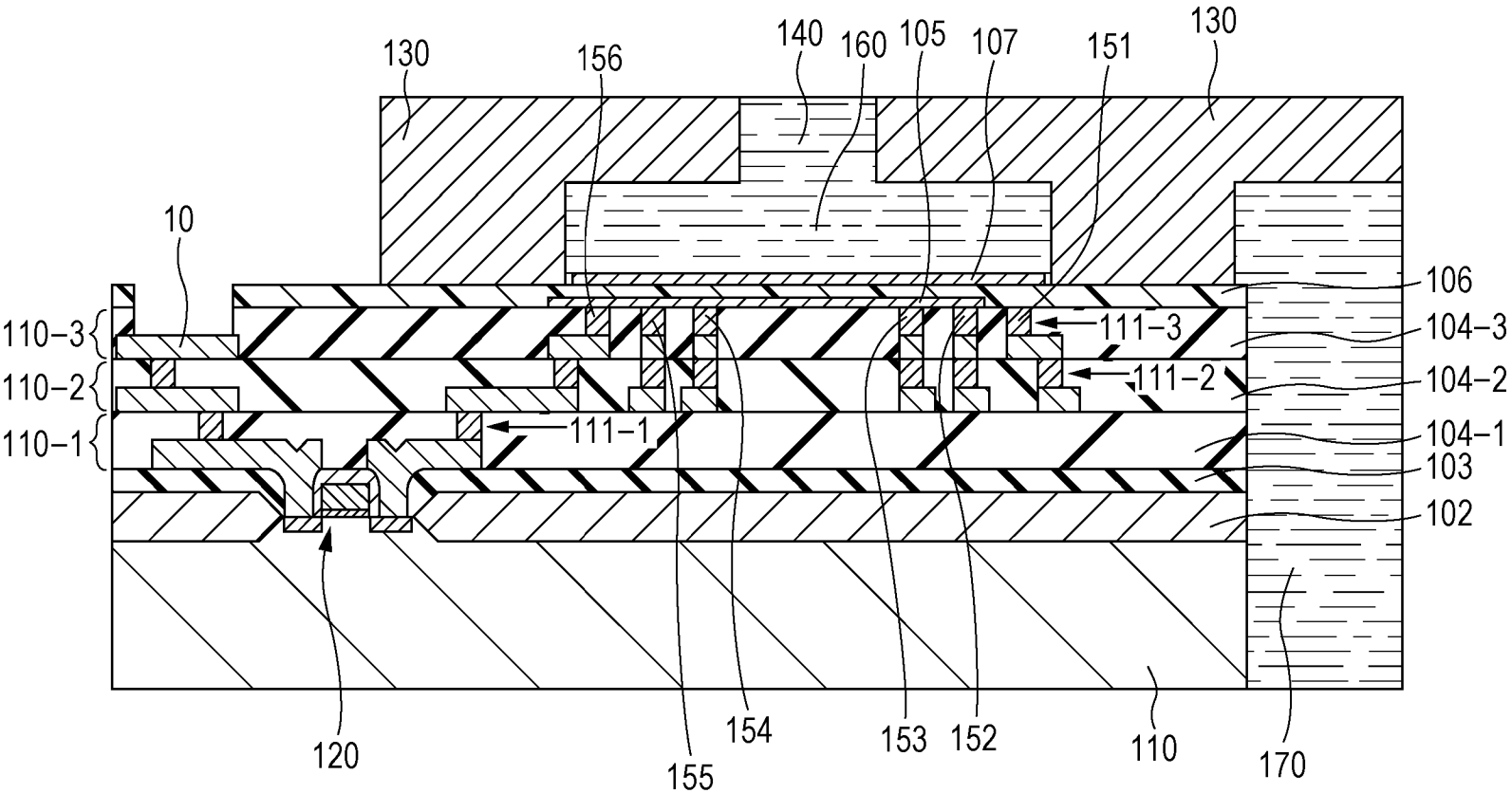
FIG. 8B is a schematic cross-sectional view showing a cross-section structure of the recording-element substrate shown in FIG. 8A.

FIG. 8A is a schematic perspective view of a recording-element substrate according to a fifth embodiment of the present disclosure. FIG. 8B is a schematic cross-sectional view showing a cross-section structure of the recording-element substrate shown in FIG. 8A taken along line VIIIB-VIIIB in a direction perpendicular to the substrate surface.

The recording-element substrate of this embodiment has the same configuration as that of the first embodiment except the heating resistance element 150 and the drive circuit.

In the first embodiment, the six electrodes 151-1 to 151-3 and 154-1 to 154-3 of the heating resistance element 150 are formed in the fourth wiring layer 110-4. In this embodiment, not the fourth wiring layer 110-4 but the third vias 111-3 are used to form seven electrodes 151, seven electrodes 152, seven electrodes 153, seven electrodes 154, seven electrodes 155, seven electrodes 156, and seven electrodes 157 as electrodes of the heating resistance element 150.

A procedure for forming the third vias 111-3 is the same as that in the first embodiment, and a description thereof will be omitted.

The electrodes 151 to 156 are formed of the third vias 111-3, and then the heating resistor layer 105 composed of TaSiN or WSiN is formed by the sputtering method. The heating resistor layer 105 is processed to a desired size by the lithography process and the dry etching process.

After the heating resistor layer 105 is processed, the passivation layer 106, the anti-cavitation layer 107, the terminals 10, the liquid supply ports 170, and the channel-formed member 130 are formed in sequence following the same procedure as that of the first embodiment. This embodiment may also has an adhesive layer made of a polyether amide resin or the like between the passivation layer 106 and the channel-formed member 130 to enhance the adhesiveness between the passivation layer 106 and the channel-formed member 130.

Figure 8C:
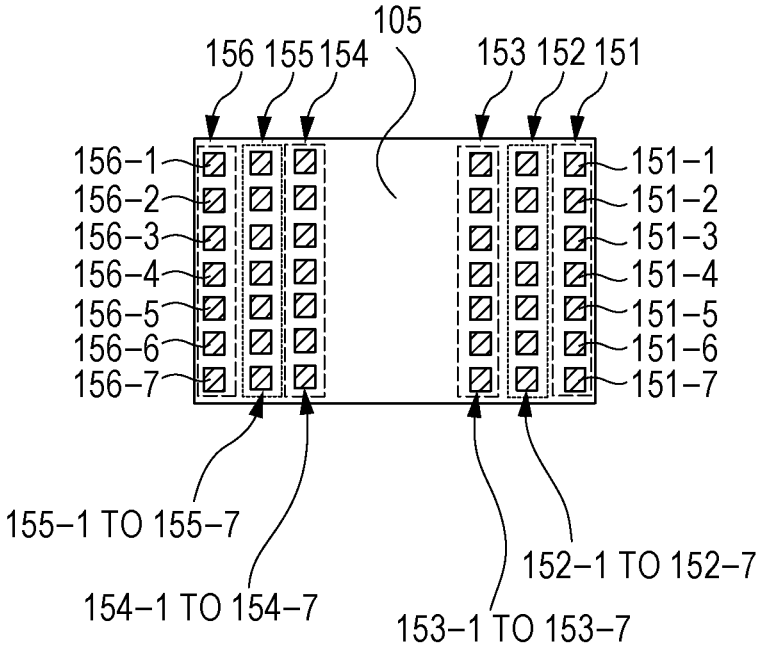
FIG. 8C is a schematic plan view of a heating resistance element provided on the recording-element substrate shown in FIG. 8A.

FIG. 8C is a schematic plan view of the heating resistance element 150.

As shown in FIG. 8C, the heating resistance element 150 includes one heating resistor layer 105 and electrodes 151-1 to 151-7, 152-1 to 152-7, 153-1 to 153-7, 154-1 to 154-7, 155-1 to 155-7, and 156-1 to 156-7.

The electrodes 151-1 to 151-7 are formed at regular intervals on one of two opposing sides of the heating resistor layer 105. The electrodes 152-1 to 152-7 are formed at regular intervals inside the electrodes 151-1 to 151-7, and on further inside thereof, the electrodes 153-1 to 153-7 are formed at regular intervals.

The electrodes 156-1 to 156-7 are formed at regular intervals on the other of the two sides, on the inside of which the electrodes 155-1 to 155-7 are formed at regular intervals, and on further inside of which, the electrodes 154-1 to 154-7 are formed at regular intervals.

In the following description, the electrode 151 represents the whole of the electrodes 151-1 to 151-7, and the electrode 152 represents the whole of the electrodes 152-1 to 152-7. The electrode 153 represents the whole of the electrodes 153-1 to 153-7, and the electrode 154 represents the whole of the electrodes 154-1 to 154-7. The electrode 155 represents the whole of the electrodes 155-1 to 155-7, and the electrode 156 represents the whole of the electrodes 156-1 to 156-7.

The drive circuit for the heating resistance element 150 selectively supplies electric power to between one of the electrodes 151 to 153 and one of the electrode 154 to 157 in response to a signal supplied via the terminal 10.

Circuit Configuration

Next, the circuit configuration of the recording-element substrate will be described.

Figure 9:
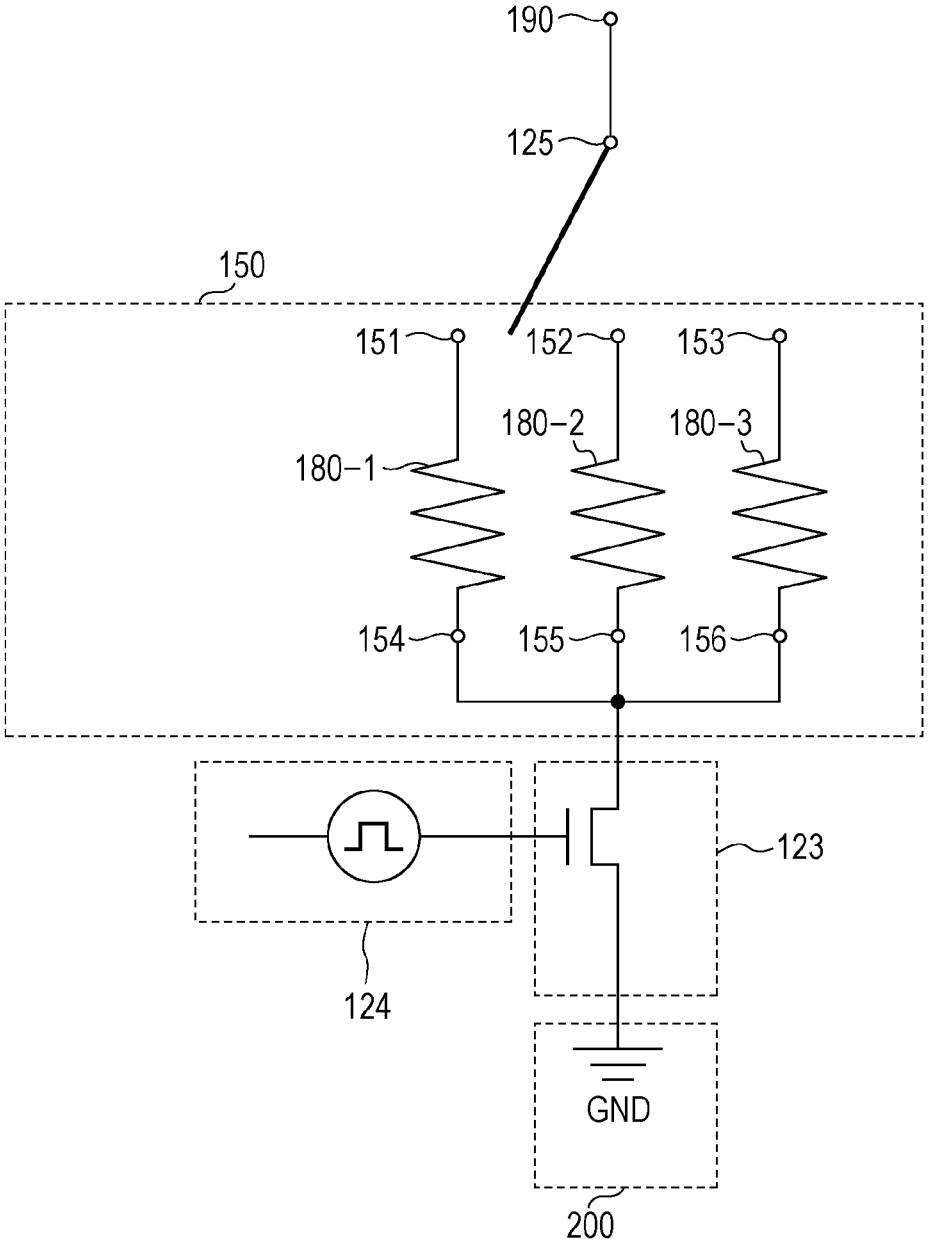
FIG. 9 is a circuit diagram illustrating an example of a circuit of the recording-element substrate shown in FIG. 8A.

FIG. 9 is a circuit diagram illustrating an example of a circuit of the recording-element substrate shown in FIG. 8A to FIG. 8C.

As shown in FIG. 9, the circuit of the recording-element substrate includes the electrode 190, the heating resistance element 150, the driving element 123, the driving pulse circuit 124, and the switching element 125. Electric power is supplied to the electrode 190 via the terminal 10.

The heating resistance element 150 includes resistors 180-1, 180-2, and 180-3 and electrodes 151 to 156.

One end of the resistor 180-1 is connected to the electrode 151, and the other end is connected to the electrode 154. One end of the resistor 180-2 is connected to the electrode 152, and the other is connected to the electrode 155. One end of the resistor 180-3 is connected to the electrode 153, and the other end is connected to the electrode 156.

The resistor 180-1 corresponds to a resistor formed of the area between the electrodes 151-1 to 151-7 and the electrodes 154-1 to 154-7 of the heating resistor layer 105 shown in FIG. 8C. The resistor 180-2 corresponds to a resistor formed of the area between the electrodes 152-1 to 152-7 and the electrodes 155-1 to 155-7 of the heating resistor layer 105 shown in FIG. 8C. The resistor 180-3 corresponds to a resistor formed of the area between the electrodes 153-1 to 153-7 and the electrodes 156-1 to 156-7 of the heating resistor layer 105 shown in FIG. 8C.

The switching element 125 selectively supplies electric power supplied from the electrode 190 to one of the electrodes 151 to 153. The driving element 123 is a transistor or the like, of which one of the source and the drain is connected to the GND 200, and the other is connected to the electrode 154 to 156. The GND 200 is grounded via the terminal 10.

The driving pulse circuit 124 outputs a driving pulse signal. The driving pulse signal output from the driving pulse circuit 124 is supplied to the gate terminal of the driving element 123.

The driving element 123, the driving pulse circuit 124, and the switching element 125 constitute a drive circuit for driving the heating resistance element 150.

In this embodiment, the switching element 125 selects one of the resistors 180-1 to 180-3 on the basis of image data and a signal indicating the moving direction and moving speed of the liquid ejection head. The driving pulse circuit 124 generates a driving pulse signal based on the image data. Since the driving element 123 operates on the basis of the driving pulse signal generated by the driving pulse circuit 124, an electric current flows through a resistor selected by the switching element 125.

Liquid Ejection Apparatus

Figure 10A:
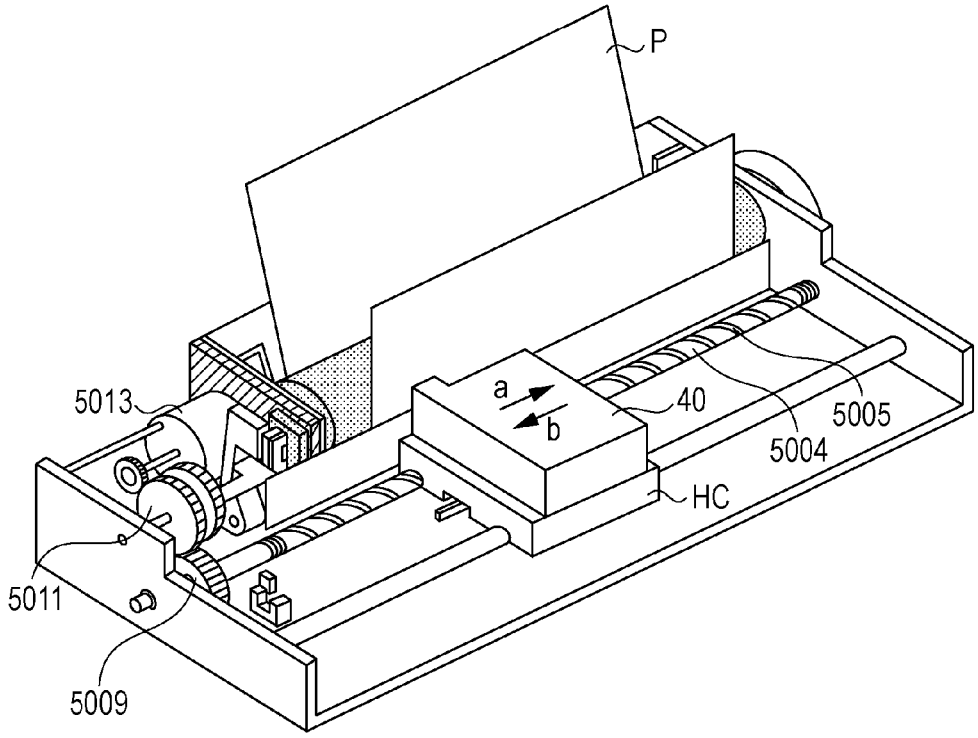
FIG. 10A is a perspective view of a liquid ejection apparatus to which a recording-element substrate according to an embodiment of the present disclosure is applicable.

The configuration of a liquid ejection apparatus equipped with the recording-element substrate of this embodiment will now be described. FIG. 10A is a perspective view of a liquid ejection apparatus to which a recording-element substrate according to an embodiment of the present disclosure is applicable.

As shown in FIG. 10A, a lead screw 5004 rotates via driving-force transmission gears 5011 and 5009 in cooperation with the forward-reverse rotation of an encoder-equipped driving motor 5013. A carriage HC can carry a head unit and has a pin (not shown) that engages with a spiral groove 5005 of the lead screw 5004. As the lead screw 5004 rotates, the carriage HC moves back and forth in the directions indicated by arrows a and b. The carriage HC carries a head unit 40 serving as a liquid ejection head.

Figure 10B:
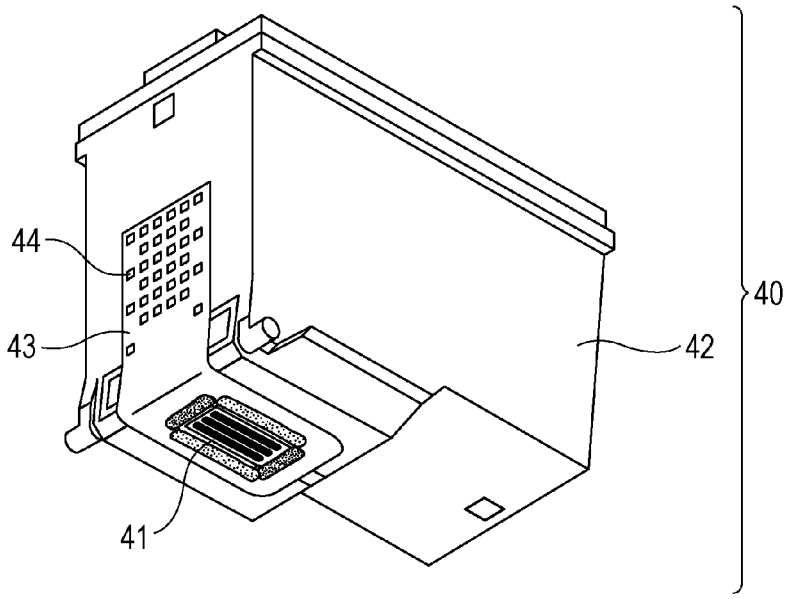
FIG. 10B is a perspective view of a head unit of the liquid ejection apparatus shown in FIG. 10A.

FIG. 10B is a perspective view of the head unit 40.

As shown in FIG. 10B, a liquid ejection head 41 is in conduction with a contact pad 44 for electrically connecting with the liquid ejection apparatus via a flexible-film wiring board 43. The head unit 40 is composed of the liquid ejection head 41 and an ink tank 42. The head unit 40 may be configured to be separated from the ink tank 42.

Although not shown, the recording-element substrate mounted on the liquid ejection head 41 includes a shift resistor to which image data is serially input and a latch circuit that temporarily stores data output from the shift resistor. The switching element 125 selects one of the electrodes 151 to 153 on the basis of the data stored in the latch circuit and a head movement signal indicating the moving direction and speed of the head unit 40 received from a driving unit including the encoder-equipped driving motor 5013.

The driving pulse circuit 124 supplies a driving pulse signal to the driving element 123 on the bases of the data stored in the latch circuit. The use of the data stored in the latch circuit allows the switching operation of the switching element 125 and the operation of the driving pulse circuit 124 to be synchronized.

In this embodiment, the drive circuit performs the following first to third driving operations.

First Driving Operation

Figure 11A:
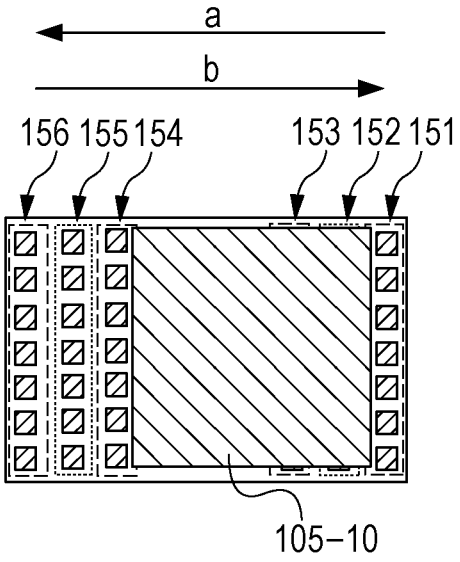
Figure 11B:
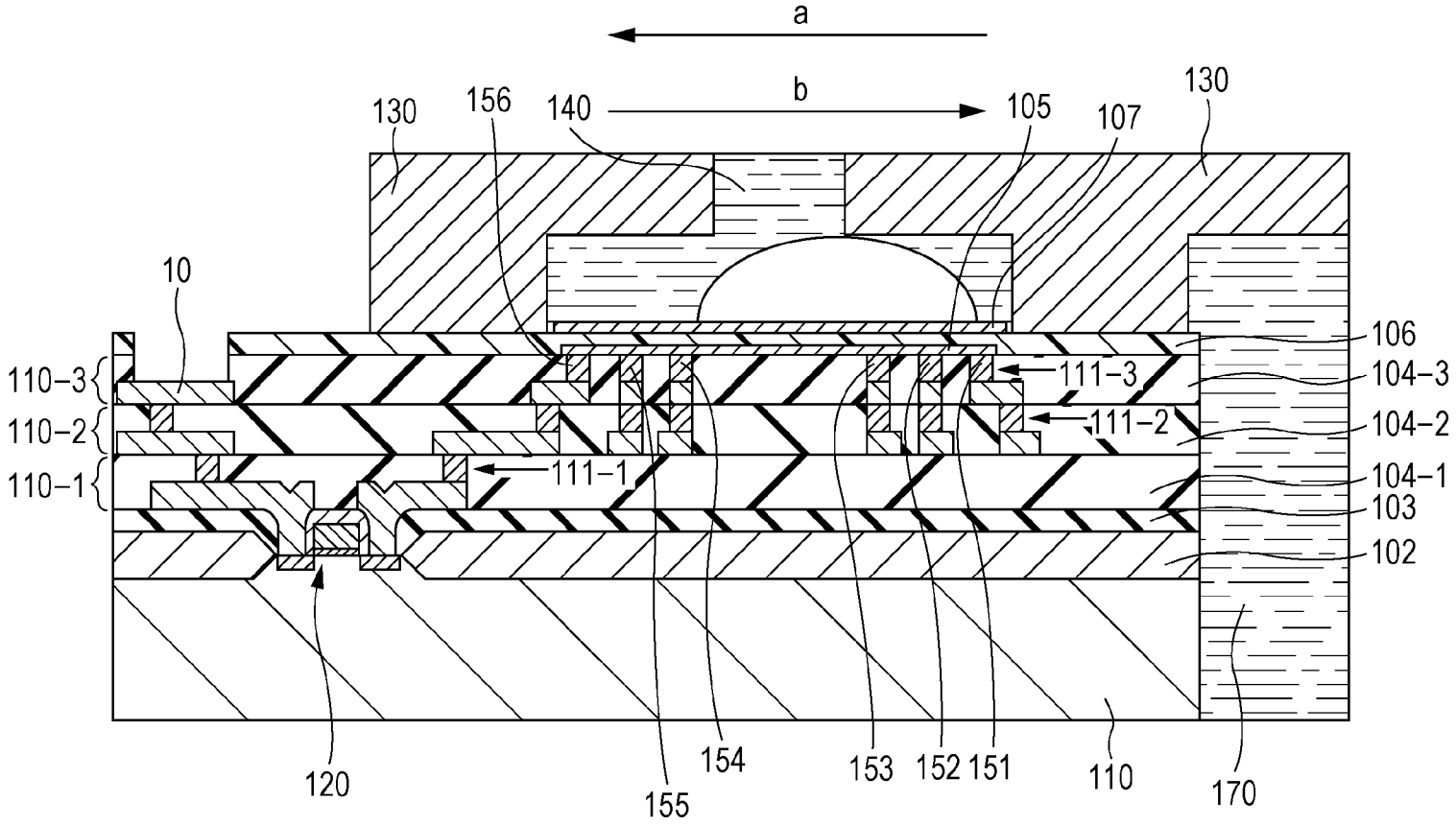
FIG. 11B is a schematic cross-sectional view illustrating the state of a bubble when the liquid is heated by the heating area shown in FIG. 11A.
Figure 11C:
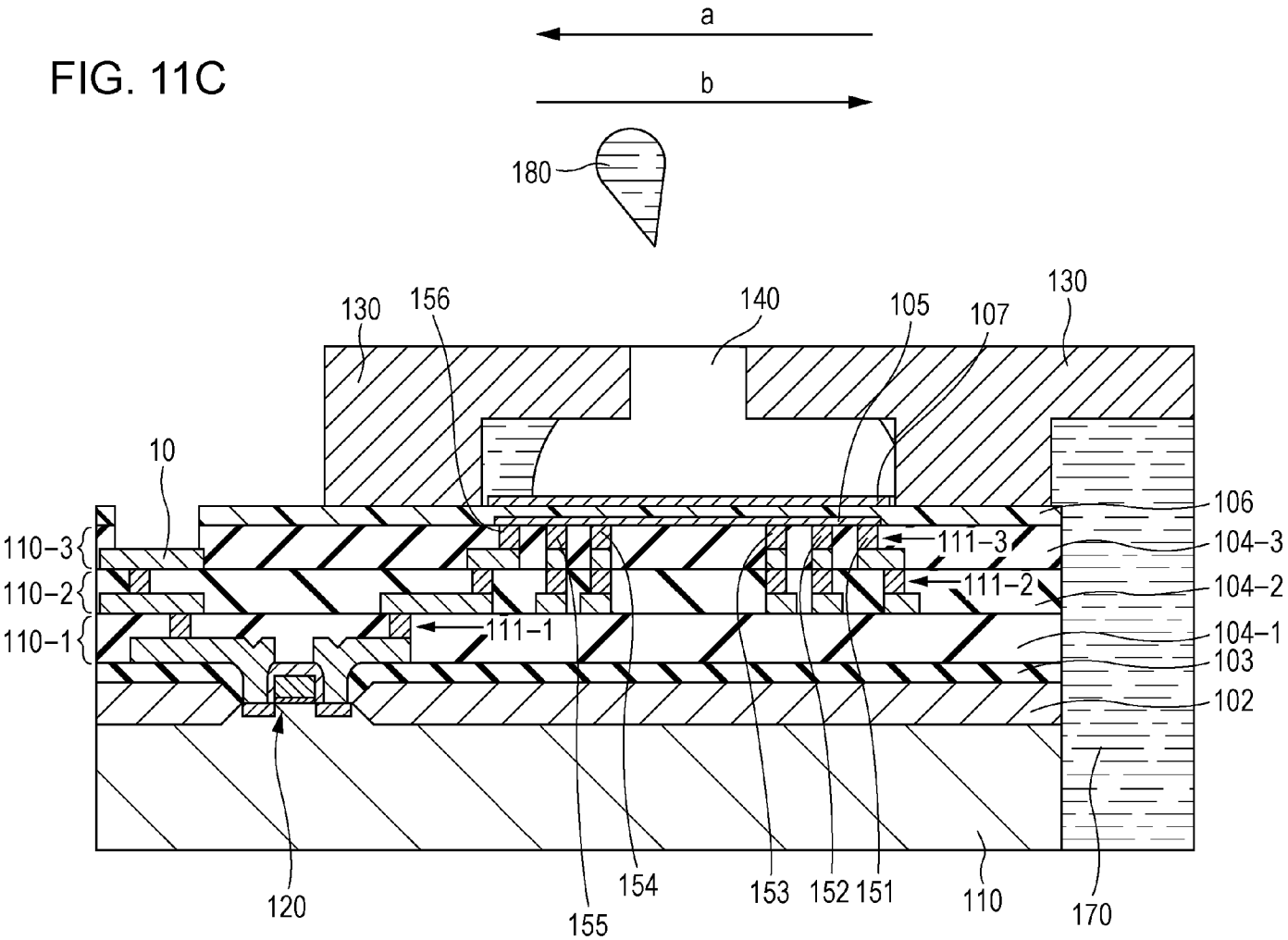
FIG. 11C is a schematic cross-sectional view illustrating a state in which a droplet is ejected due to the growth of the bubble shown in FIG. 11B.

FIG. 11A is a schematic plan view of the heating area of the heating resistor layer 105 when the head unit 40 moves in the direction of arrow a. FIGS. 11B and 11C are schematic cross-sectional views illustrating the state of a bubble and the liquid ejecting direction when the liquid is heated by the heating area shown in FIG. 11A. When the head unit 40 moves in the direction of arrow a, a head movement signal indicating the movement in the direction of arrow a and its moving speed is output from the encoder-equipped driving motor 5013.

The encoder-equipped driving motor 5013 outputs a head movement signal indicating that the head unit 40 is moving in the direction of arrow a at a speed equal to or higher than a threshold value. The switching element 125 selects the resistor 180-1 on the basis of the head movement signal and the data stored in the latch circuit and supplies electric power output from the electrode 190 to the electrode 151. The driving pulse circuit 124 supplies a driving pulse signal to the driving element 123 on the basis of the data stored in the latch circuit.

When the driving element 123 operates in response to the driving pulse signal output from the driving pulse circuit 124, an electric current flows through the resistor 180-1. This causes thermal energy to be generated in the heating area 105-10 between the electrodes 151-1 to 151-7 and the electrodes 154-1 to 154-7 shown in FIG. 11A, and the liquid in the pressure chamber 160 is heated by the thermal energy to generate bubbles. The liquid is ejected from the ejection port 140 through a series of processes, that is, generation, growth, and shrinkage of bubbles.

If the heating resistor layer 105 is viewed from the ejection port 140 side, the center of the heating area 105-10 is at a position a little shifted from the center of the ejection port 140 in the direction opposite to the direction of arrow a (the direction of arrow b). Thus, as shown in FIG. 11B, a bubble is generated not directly below the ejection port 140 but at a position a little shifted from directly below the ejection port 140 in the direction of arrow b. As a result, as shown in FIG. 11C, a droplet 180 is ejected at an angle a little inclined from the direction perpendicular to the surface (opening surface) of the ejection port 14 in the direction of arrow a.

If the moving speed of the head unit 40 is less than the threshold value, the following second driving operation is performed.

Second Driving Operation

Figure 12A:
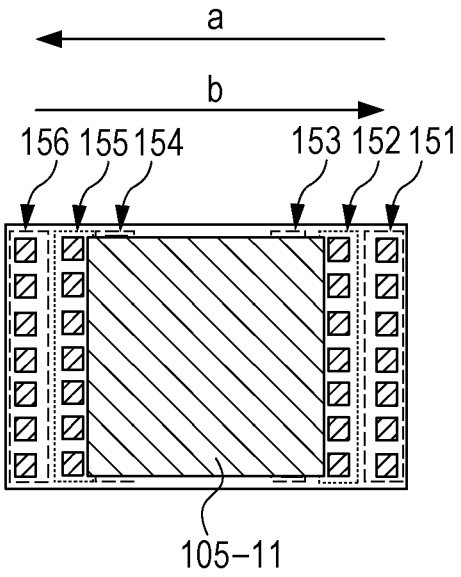
FIG. 12A is a schematic plan view of the heating area of the heating resistance element when the head unit of the liquid ejection apparatus shown in FIG. 10A is stopped.
Figure 12B:
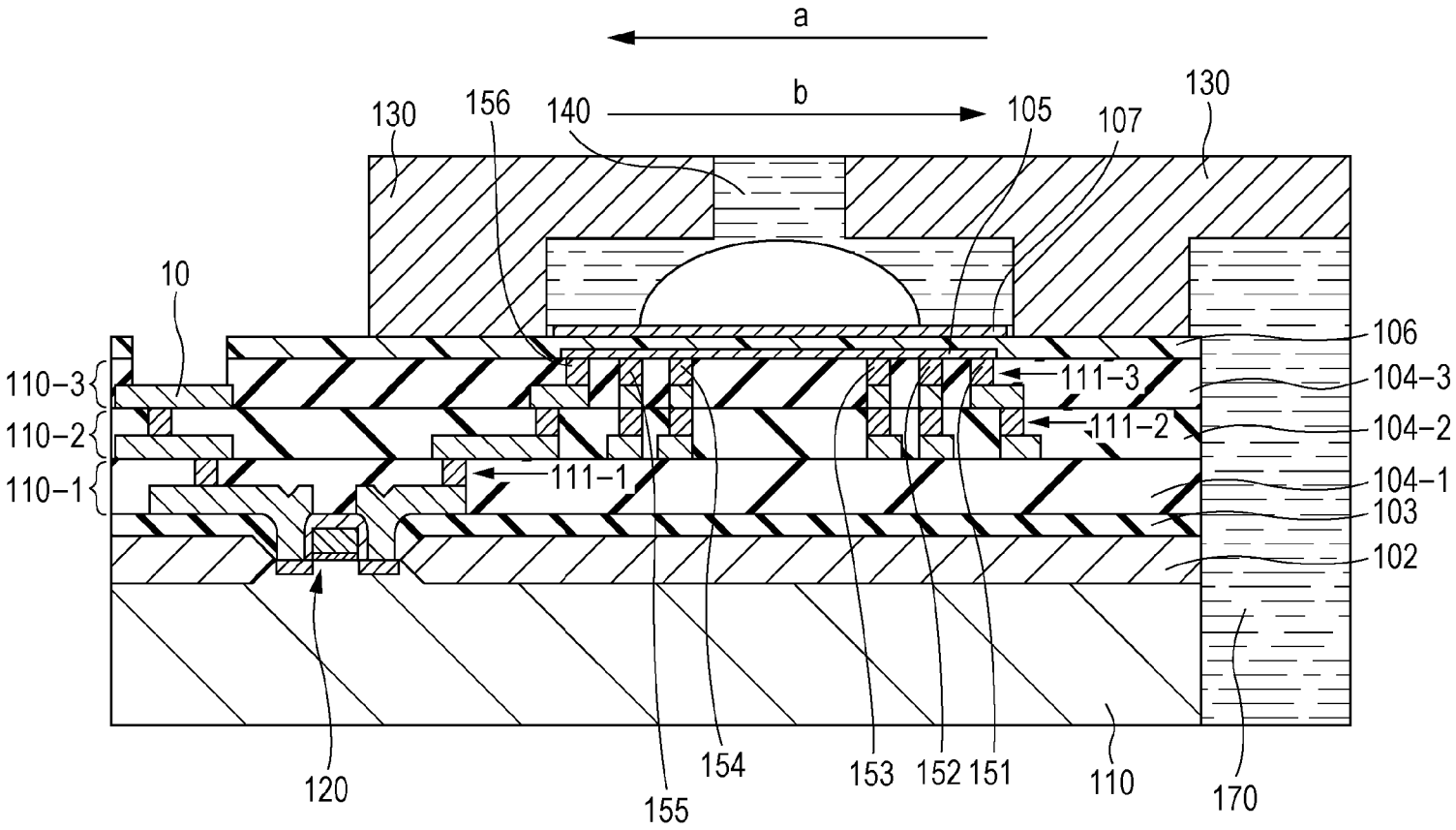
FIG. 12B is a schematic cross-sectional view illustrating the state of a bubble when the liquid is heated by the heating area shown in FIG. 12A.
Figure 12C:
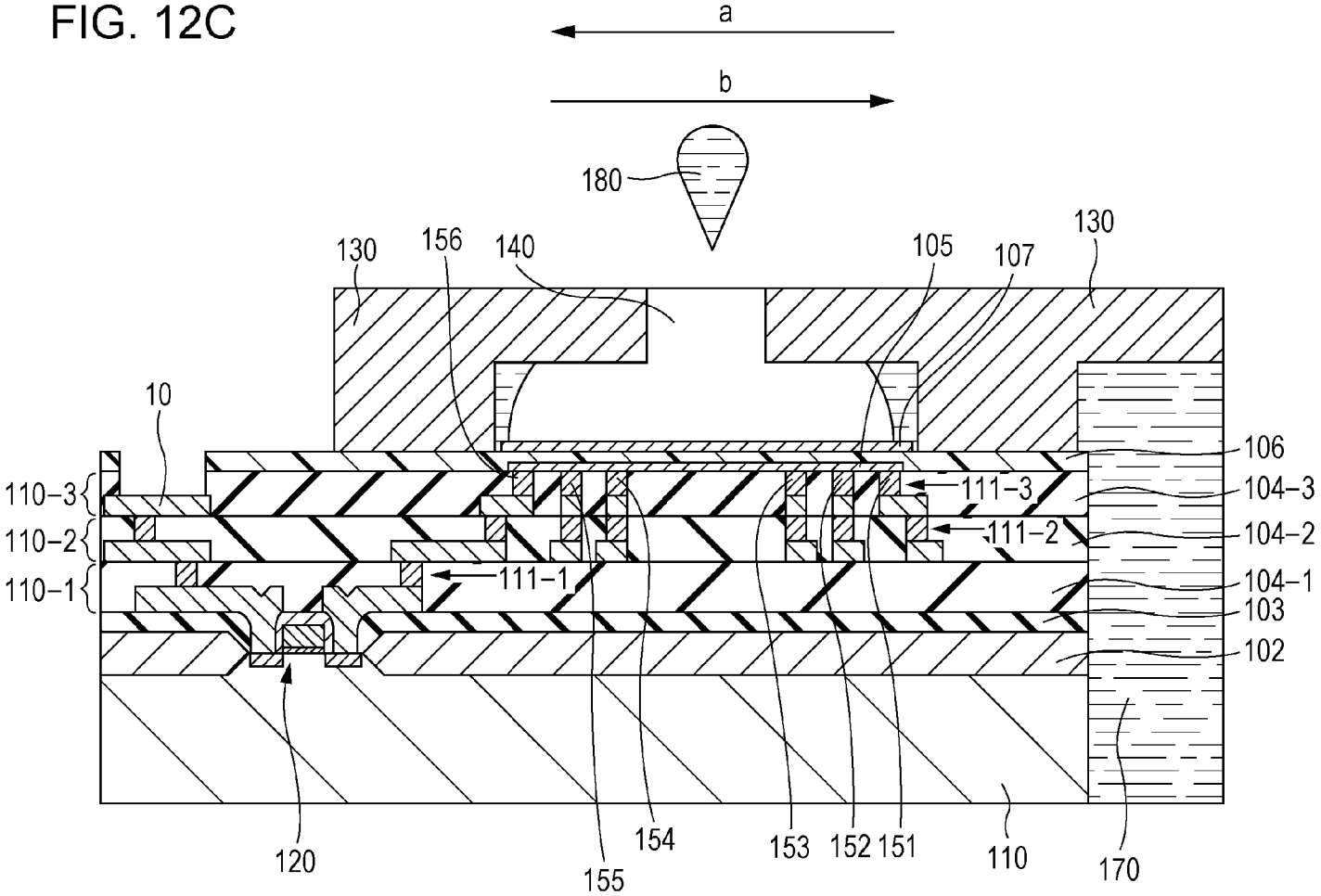
FIG. 12C is a schematic cross-sectional view illustrating a state in which a droplet is ejected due to the growth of the bubble shown in FIG. 12B.

FIG. 12A is a schematic plan view of the heating area of the heating resistor layer 105 when the head unit 40 is stopped. FIGS. 12B and 12C are schematic cross-sectional views illustrating the state of a bubble and the liquid ejecting direction when the liquid is heated by the heating area shown in FIG. 12A.

The encoder-equipped driving motor 5013 outputs a head movement signal indicating that the head unit 40 is stopped. The switching element 125 selects the resistor 180-2 on the basis of the head movement signal and data stored in the latch circuit and supplies electric power output from the electrode 190 to the electrode 152. The driving pulse circuit 124 supplies a driving pulse signal to the driving element 123 on the basis of the data stored in the latch circuit.

When the driving element 123 operates in response to the driving pulse signal output from the driving pulse circuit 124, an electric current flows through the resistor 180-2. This causes, as shown in FIG. 12A, thermal energy to be generated in the heating area 105-11 between the electrodes 152-1 to 152-7 and the electrodes 155-1 to 155-7, and the liquid in the pressure chambers 160 is heated by the thermal energy to generate bubbles. The liquid is ejected from the ejection port 140 through a series of processes, that is, generation, growth, and shrinkage of bubbles.

If the heating resistor layer 105 is viewed from the ejection port 140 side, the center of the heating area 105-11 substantially coincides with the center of the ejection port 140. Thus, as shown in FIG. 12B, a bubble is generated directly below the ejection port 140. As a result, as shown in FIG. 12C, the droplet 180 is ejected in a direction perpendicular to the surface (opening surface) of the ejection port 14.

Figure 13A:
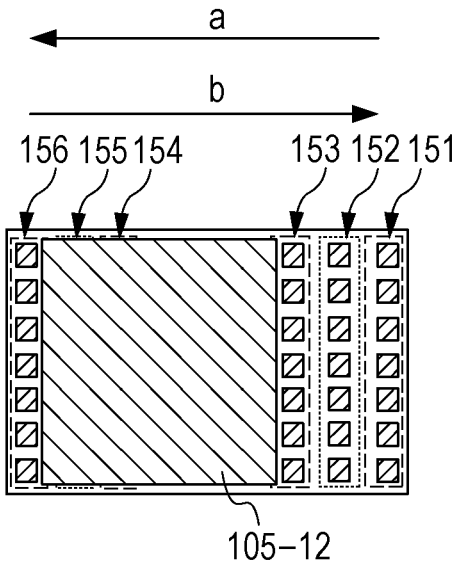
FIG. 13A is a schematic plan view of the heating area of the heating resistance element when the head unit of the liquid ejection apparatus shown in FIG. 10A moves in the direction of arrow b.
Figure 13B:
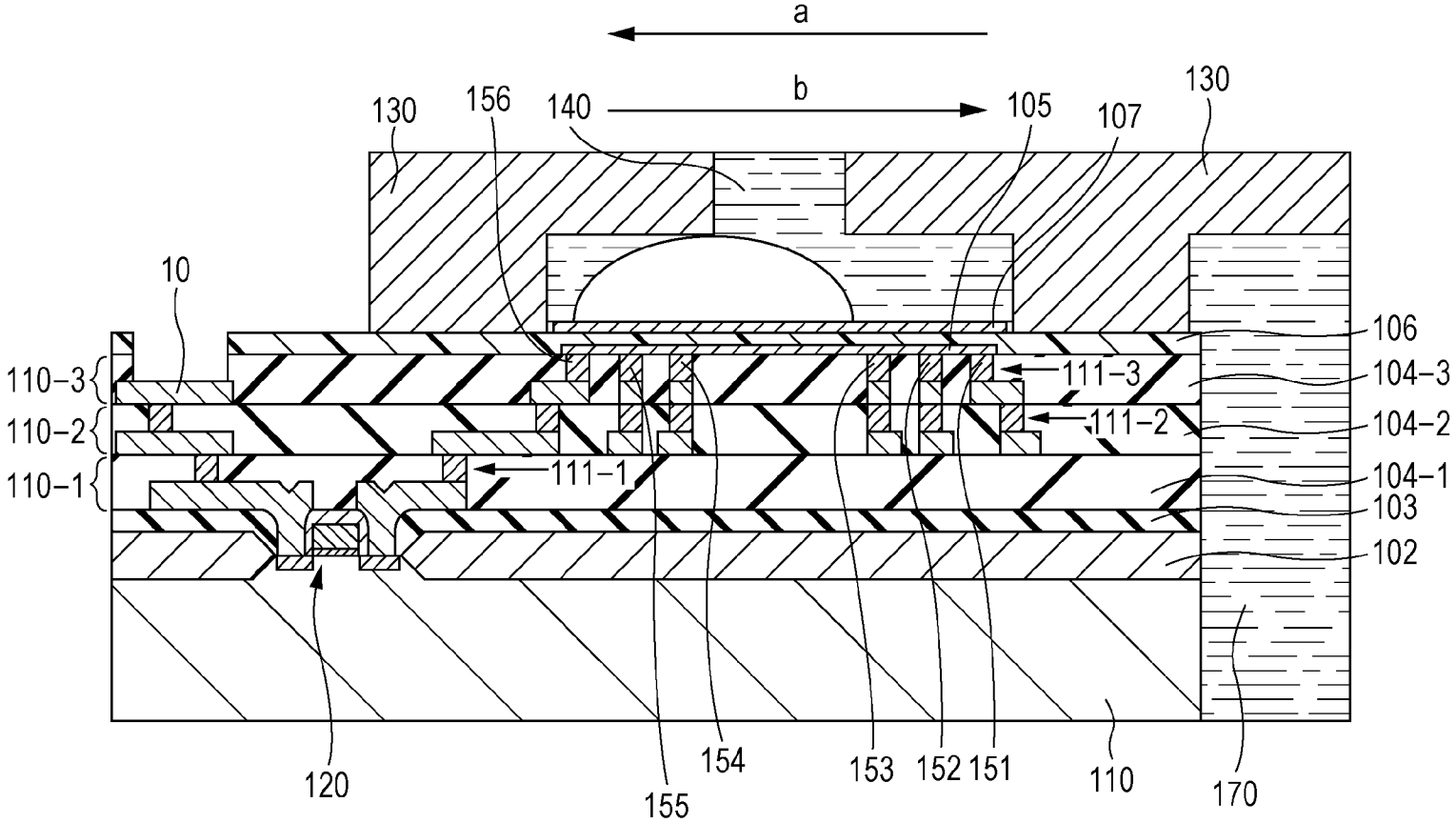
FIG. 13B is a schematic cross-sectional view illustrating the state of a bubble when the liquid is heated by the heating area shown in FIG. 13A.
Figure 13C:
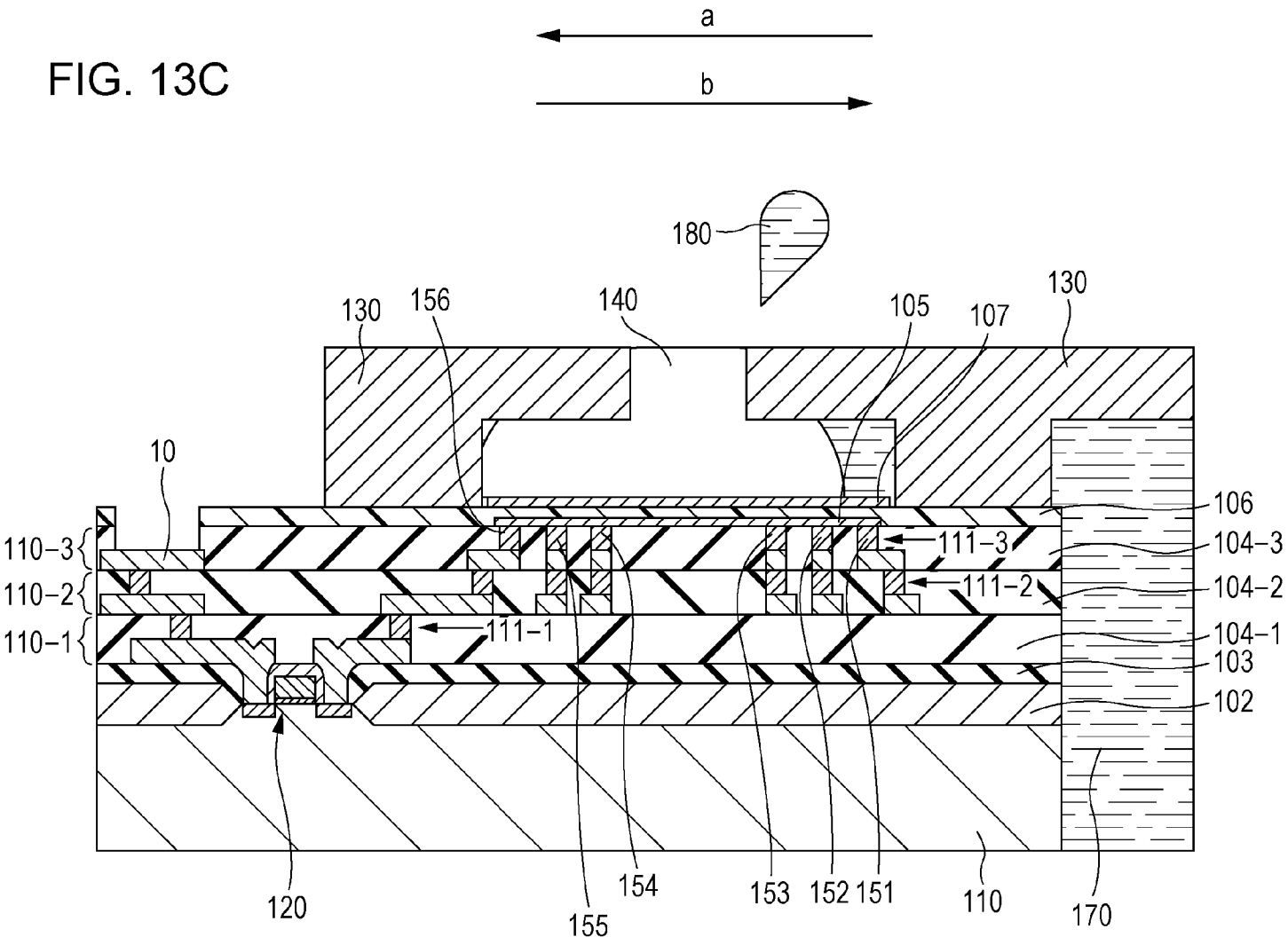
FIG. 13C is a schematic cross-sectional view illustrating a state in which a droplet is ejected due to the growth of the bubble shown in FIG. 13B.

When the head unit 40 moves in the direction of arrow a or arrow b at a speed less than the threshold value, the driving operation using the resistor 180-2 described above is performed Third Driving Operation FIG. 13A is a schematic plan view of the heating area of the heating resistor layer 105 when the head unit 40 moves in the direction of arrow b. FIGS. 13B and 13C are schematic cross-sectional views illustrating a bubble formed with the heating area shown in FIG. 13A.

When the head unit 40 moves in the direction of arrow b, a head movement signal indicating the movement in the direction of arrow b and its moving speed is output from the encoder-equipped driving motor 5013.

The encoder-equipped driving motor 5013 outputs a head movement signal indicating that the head unit 40 is moving in the direction of arrow b at a speed equal to or higher than the threshold value. The switching element 125 selects the resistor 180-3 on the basis of the head movement signal and the data stored in the latch circuit and supplies electric power output from the electrode 190 to the electrode 153. The driving pulse circuit 124 supplies a driving pulse signal to the driving element 123 on the basis of the data stored in the latch circuit.

When the driving element 123 operates in response to the driving pulse signal output from the driving pulse circuit 124, an electric current flows through the resistor 180-3. This causes thermal energy to be generated in the heating area 105-12 between the electrodes 153-1 to 153-7 and the electrodes 156-1 to 156-7 shown in FIG. 11A, and the liquid in the pressure chamber 160 is heated by the thermal energy to generate bubbles. The liquid is ejected from the ejection port 140 through a series of processes, that is, generation, growth, and shrinkage of bubbles.

If the heating resistor layer 105 is viewed from the ejection port 140 side, the center of the heating area 105-10 is at a position a little shifted from the center of the ejection port 140 in the direction opposite to the direction of arrow b (the direction of arrow a). Thus, as shown in FIG. 13B, a bubble is generated not directly below the ejection port 140 but at a position a little shifted from directly below the ejection port 140 in the direction of arrow a. As a result, as shown in FIG. 13C, the droplet 180 is ejected at an angle a little inclined from the direction perpendicular to the surface (opening surface) of the ejection port 14 in the direction of arrow b.

If the moving speed of the head unit 40 is less than the threshold value, the above second driving operation is performed.

Since the first and third driving operations allow the ejecting direction to be appropriately controlled according to the moving direction and the moving speed of the head unit 40, the accuracy of droplet landing positions is increased, so that a high-quality image can be provided.

When liquid is ejected for recording while a head unit is being moved at a predetermined speed, if liquid is ejected at a time when the head unit has reached a target position, ejected droplets normally land at positions shifted from the target position in the head moving direction. Existing liquid ejection apparatuses land droplets at target positions by ejecting the liquid before the head unit reaches the target position. However, this needs a larger head unit moving range than the maximum recordable width. The reason for this will be briefly described hereinbelow.

It is assumed that the liquid ejection apparatus shown in FIG. 10A performs recording in the full width of a recording medium P while moving the liquid ejection head 40, with the width of the recording medium P as the maximum width. If recording is performed while the liquid ejection head 40 is being moved in the direction of arrow a, the liquid ejection head 40 needs to be moved from the left end of the recording medium P leftward (toward the driving-force transmission gears 5011 and 5009) in consideration of deviation of landing positions due to the movement of the liquid ejection head 40. In contrast, if recording is performed while the liquid ejection head 40 is being moved in the direction of arrow b, the liquid ejection head 40 needs to be moved rightward from the right end of the recording medium P. Thus, the moving range of the liquid ejection head 40 is larger than the maximum recordable width.

The length of the lead screw 5004 depends on the moving range of the liquid ejection head 40. The lead screw 5004 is increased in length as the moving range of the liquid ejection head 40 becomes larger than the maximum recordable width, thus increasing the size of the liquid ejection apparatus.

In this embodiment, the moving range of the liquid ejection head 40 can be equal to the maximum recordable width by switching among the first to third driving operations as appropriate depending on the moving direction and the moving speed of the liquid ejection head 40.

Specifically, when recording is started from the left end of the recording medium P toward the right end, the liquid ejection head 40 is stopped at the left end, and from this state, moves toward the right end, and stops at the right end. In a state in which the liquid ejection head 40 is stopped at the left end and in a period during which the speed of the liquid ejection head 40 reaches the threshold value, the second driving operation is performed. When the speed of the liquid ejection head 40 reaches the threshold value, the first driving operation is performed. When the speed of the liquid ejection head 40 becomes less than the threshold value, the second driving operation is performed. This second driving operation is performed until the liquid ejection head 40 stops at the right end.

When recording is started from the right end of the recording medium P toward the left end, the liquid ejection head 40 is stopped at the right end, from this state, moves toward the left end, and stops at the left end. In a state in which the liquid ejection head 40 is stopped at the right end and in a period during which the speed of the liquid ejection head 40 reaches the threshold value, the second driving operation is performed. When the speed of the liquid ejection head 40 reaches the threshold value, the third driving operation is performed. When the speed of the liquid ejection head 40 becomes less than the threshold value, the second driving operation is performed. This second driving operation is performed until the liquid ejection head 40 stops at the right end.

Assuming that the width of the recording medium P is the maximum recordable width, the moving range of the liquid ejection head 40 in the above driving operations is equal to the maximum recordable range. This allows the lead screw 5004 to be shorter than that of the existing liquid ejection apparatuses, thus providing a compact liquid ejection apparatus.

The recording-element substrate of this embodiment also has one heating resistance element for one ejection port as in the first embodiment. Thus, the size and cost can be decreased as compared with a configuration in which a plurality of heating resistance elements are provided for one ejection port.

In addition, changing the heating-area formed range causes the cavitation occurrence position to be changed. This allows the influence of the cavitation impact to be dispersed, thus enhancing the durability of the heating resistance elements.

Since the electrodes of the heating resistance element 150 are formed not using the fourth wiring layer 110-4 but using the third vias 111-3, a structure with less level difference than that of the first embodiment can be provided. This can decrease the thickness of the passivation layer 106 on the heating resistance element 150. In addition, the heating resistance element 150 can also be decreased in size, so that the recording-element substrate can be decreased in size (chip size).

The number of the electrodes of the heating resistance element 150 is not limited to 42. The number of the electrodes of the heating resistance element 150 is three or more. The number and combination of electrode pairs can also be changed as appropriate provided that the heating-area formed area can be changed by selectively using two or more electrodes.

To minimize heat that escapes through the vias and wiring lines, the third wiring layer 110-3 and the third vias 111-3 may be as thin as possible. For example, the third wiring layer 110-3 and the third vias 111-3 may be thinner than the second wiring layer 110-2 and the second vias 111-2.

The heating area 105-10 is off to the right (in the direction of arrow a) from the heating area 105-11, and the heating area 105-12 is off to the left (in the direction of arrow b) from the heating area 105-11. The amounts of shift of the heating areas 105-10 and 105-12 from the heating area 105-11 can be appropriately set in consideration of the control range of the ejecting direction. The amount of shift between the heating areas 105-10 and 105-11 and the amount of shift between the heating areas 105-11 and 105-12 may be set substantially equal.

Sixth Embodiment

Figure 14A:
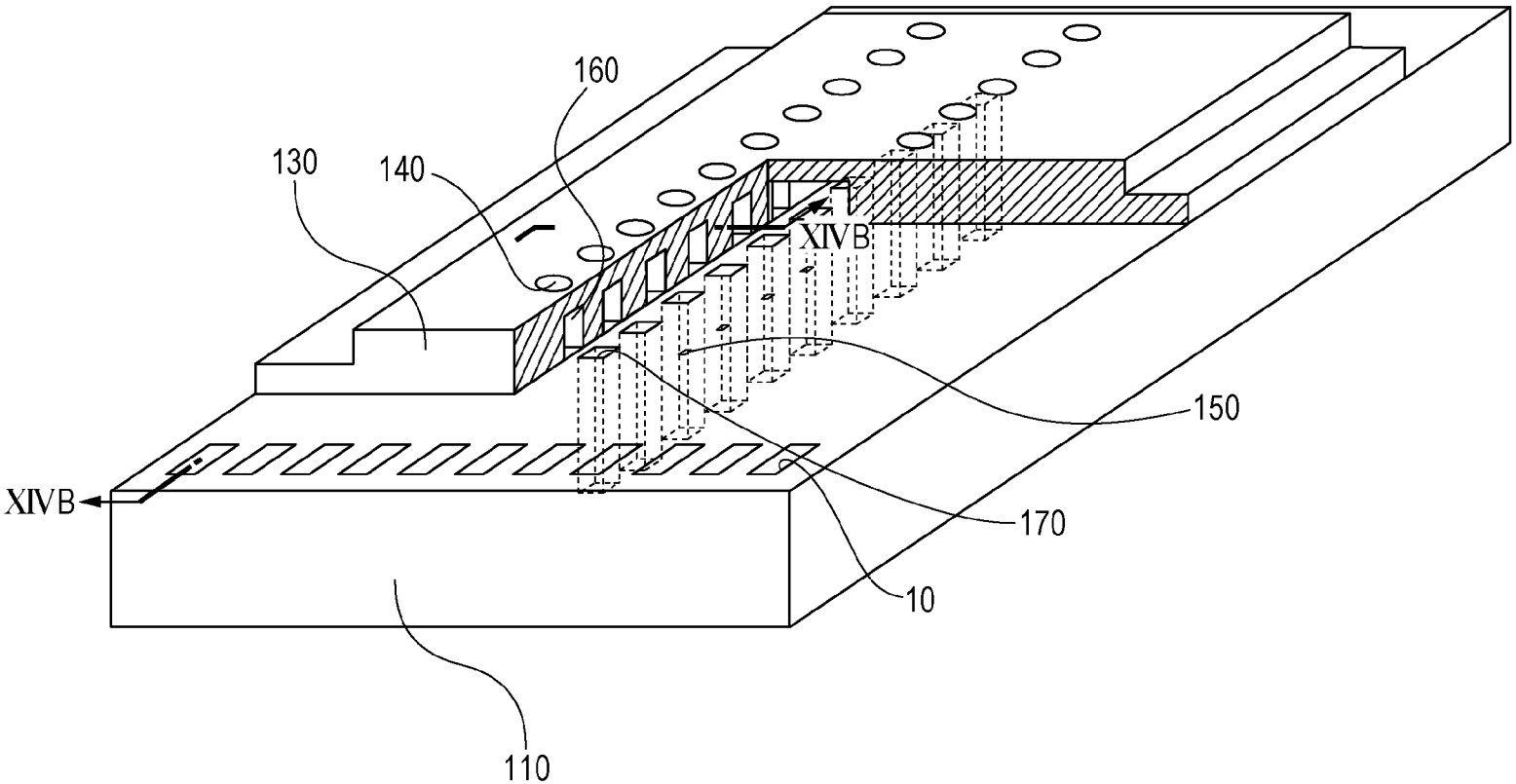
FIG. 14A is a schematic perspective view of a recording-element substrate according to a sixth embodiment of the present disclosure.
Figure 14B:
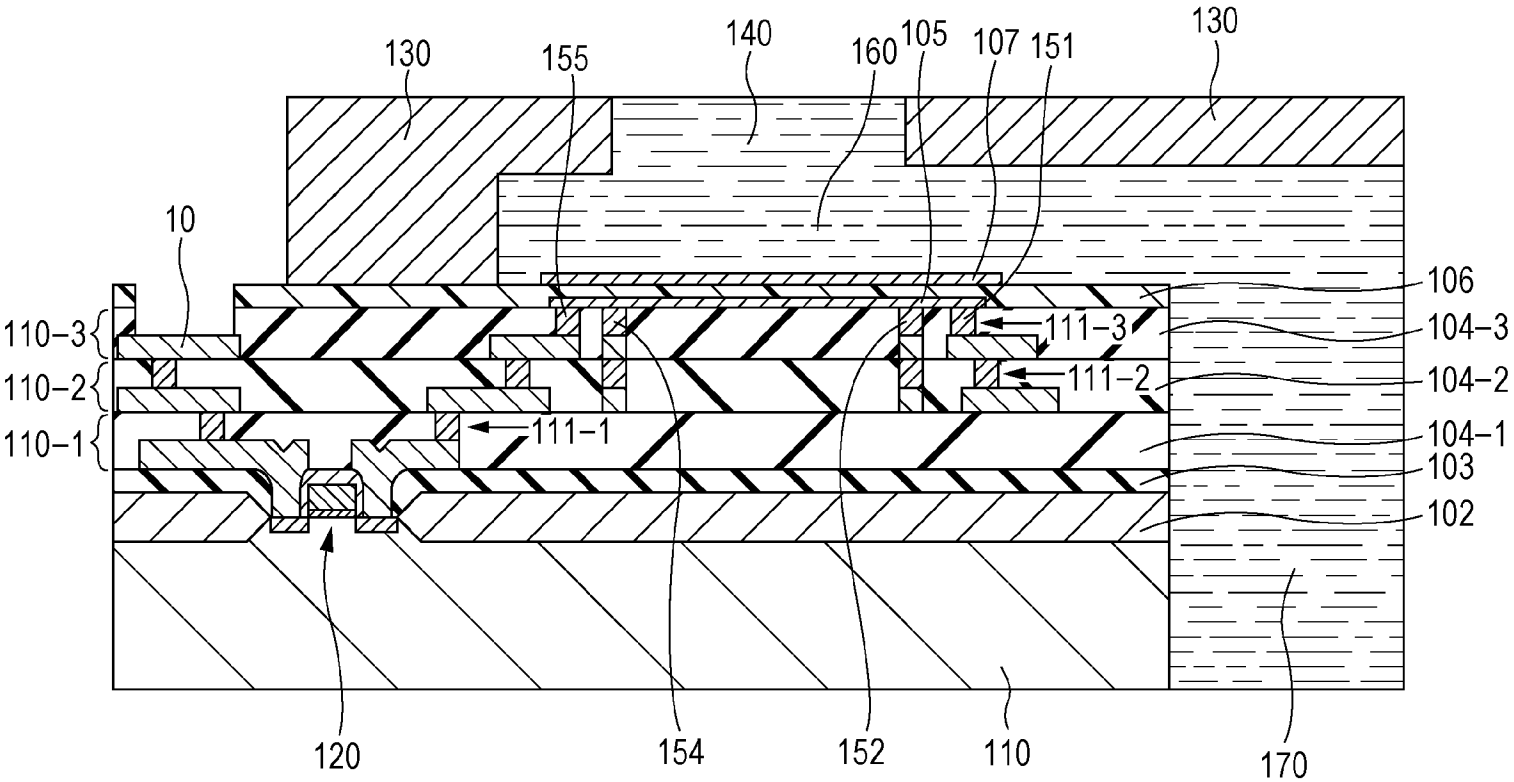
FIG. 14B is a schematic cross-sectional view showing a cross-section structure of the recording-element substrate shown in FIG. 14A.

FIG. 14A is a schematic perspective view of a recording-element substrate according to a sixth embodiment of the present disclosure. FIG. 14B is a schematic cross-sectional view showing a cross-section structure of the recording-element substrate shown in FIG. 14A taken along line XIVB-XIVB in a direction perpendicular to the substrate surface.

The recording-element substrate of this embodiment has the same configuration as that of the first embodiment except the heating resistance element 150 and the drive circuit.

In the first embodiment, the six electrodes 151-1 to 151-3 and 154-1 to 154-3 of the heating resistance element 150 are formed in the fourth wiring layer 110-4. In this embodiment, not the fourth wiring layer 110-4 but the third vias 111-3 are used to form seven electrodes 151, seven electrodes 152, seven electrodes 154, and seven electrodes 155 as electrodes of the heating resistance element 150.

A procedure for forming the third vias 111-3 is the same as that in the first embodiment, and a description thereof will be omitted.

The electrodes 151, 152, 154, and 155 are formed of the third vias 111-3, and then the heating resistor layer 105 composed of TaSiN or WSiN is formed by the sputtering method. The heating resistor layer 105 is then processed into a desired size by the lithography process and the dry etching process.

After the heating resistor layer 105 is processed, the passivation layer 106, the anti-cavitation layer 107, the terminals 10, the liquid supply ports 170, and the channel-formed member 130 are formed in sequence following the same procedure as that of the first embodiment. This embodiment may also has an adhesive layer made of a polyether amide resin or the like between the passivation layer 106 and the channel-formed member 130 to enhance the adhesiveness between the passivation layer 106 and the channel-formed member 130.

Figure 14C:
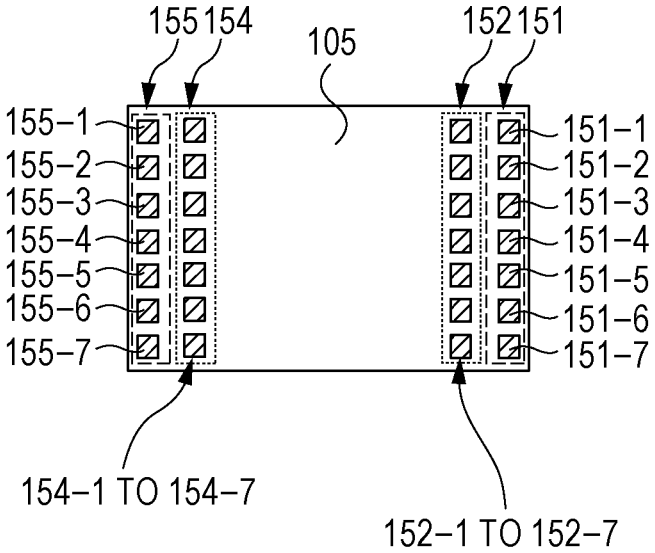
FIG. 14C is a schematic plan view of a heating resistance element provided on the recording-element substrate shown in FIG. 14A.

FIG. 14C is a schematic plan view of the heating resistance element 150.

As shown in FIG. 14C, the heating resistance element 150 includes one heating resistor layer 105 and electrodes 151-1 to 151-7, 152-1 to 152-7, 154-1 to 154-7, and 155-1 to 155-7.

The electrodes 151-1 to 151-7 are formed at regular intervals on one of two opposing sides of the heating resistor layer 105, and inside of which the electrodes 152-1 to 152-7 are formed at regular intervals. The electrodes 155-1 to 155-7 are formed at regular intervals on the other of the two sides, and inside of which the electrodes 154-1 to 154-7 2 are formed at regular intervals.

In the following description, the electrode 151 represents the whole of the electrodes 151-1 to 151-7, and the electrode 152 represents the whole of the electrodes 152-1 to 152-7. The electrode 154 represents the whole of the electrodes 154-1 to 154-7, and the electrode 155 represents the whole of the electrodes 155-1 to 155-7.

The drive circuit for the heating resistance element 150 selectively supplies electric power either to between the electrode 151 and the electrode 154 or to between the electrode 152 and the electrode 155 in response to a signal supplied via the terminal 10.

Circuit Configuration

Next, the circuit configuration of the recording-element substrate will be described.

Figure 15:
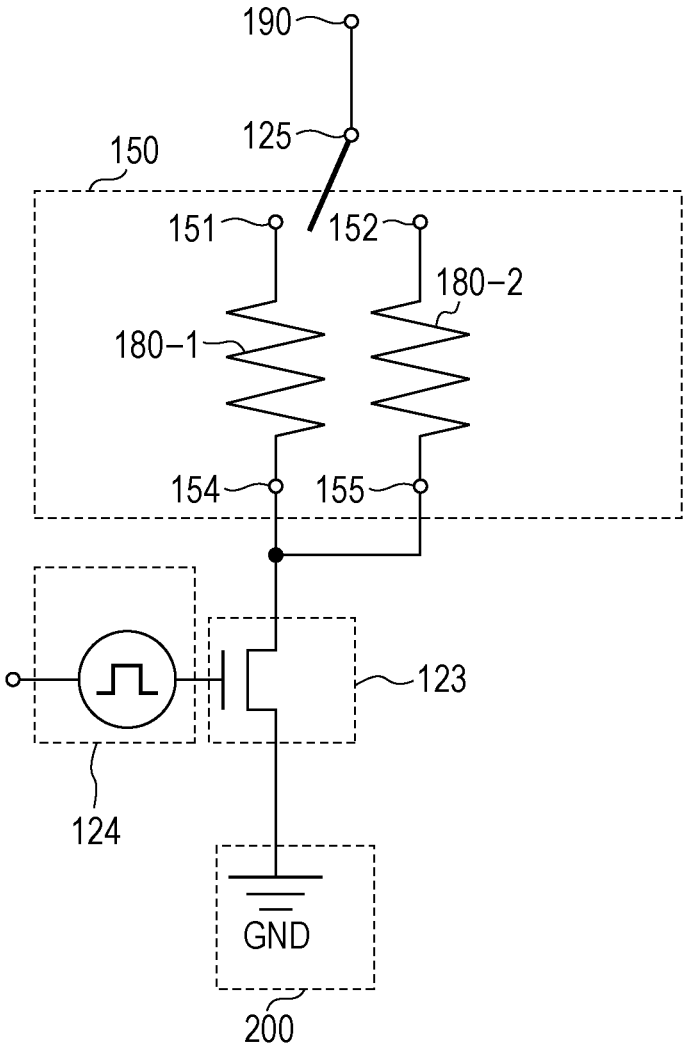
FIG. 15 is a circuit diagram illustrating one example of a circuit of the recording-element substrate shown in FIG. 14A.

FIG. 15 is a circuit diagram illustrating one example of a circuit of the recording-element substrate shown in FIGS. 14A to 14C.

As shown in FIG. 15, the circuit of the recording-element substrate includes the electrode 190, the heating resistance element 150, the driving element 123, the driving pulse circuit 124, and the switching element 125. Electric power is supplied to the electrode 190 via the terminal 10.

The heating resistance element 150 includes resistors 180-1 and 180-2 and electrodes 151, 152, 154, and 155. One end of the resistor 180-1 is connected to the electrode 151, and the other end is connected to the electrode 154. One end of the resistor 180-2 is connected to the electrode 152, and the other end is connected to the electrode 155.

The resistor 180-1 corresponds to a resistor formed of the area between the electrodes 151-1 to 151-7 and the electrodes 154-1 to 154-7 of the heating resistor layer 105 shown in FIG. 14C. The resistor 180-2 corresponds to a resistor formed of the area between the electrodes 152-1 to 152-7 and the electrodes 155-1 to 155-7 of the heating resistor layer 105 shown in FIG. 14C.

The switching element 125 selectively supplies electric power supplied from the electrode 190 to one of the electrodes 151 and 152. The driving element 123 is a transistor or the like, of which one of the source and the drain is connected to the GND 200, and the other is connected to the electrodes 154 and 155. The GND 200 is grounded via the terminal 10.

The driving pulse circuit 124 outputs a driving pulse signal. The driving pulse signal output from the driving pulse circuit 124 is supplied to the gate terminal of the driving element 123.

The driving element 123, the driving pulse circuit 124, and the switching element 125 constitute a drive circuit for driving the heating resistance element 150. Note that the drive circuit is given for mere illustration and any other configuration can be used in the present disclosure as needed. For example, the switching element 125 may be provided outside the drive circuit. The drive circuit may include other devices and circuits for driving the heating resistance element 150.

In this embodiment, the switching element 125 selects the resistors 180-1 and 180-2 alternately on the basis of image data. The driving pulse circuit 124 generates a driving pulse signal on the basis of the image data. Since the driving element 123 operates in response to the driving pulse signal output from the driving pulse circuit 124, an electric current flows through a resistor selected by the switching element 125.

First Driving Operation

Figure 16A:
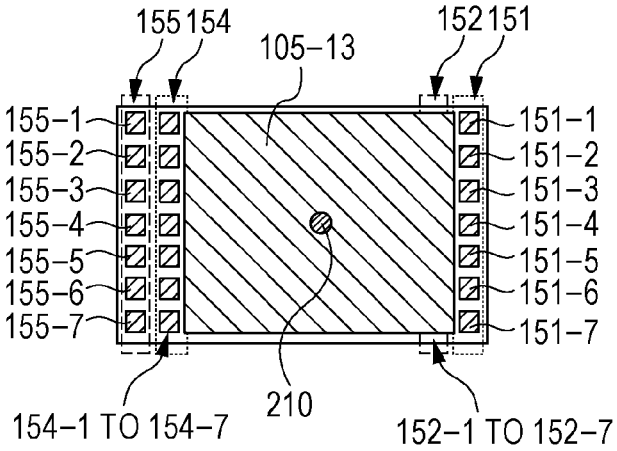
FIG. 16A is a schematic plan view showing an example of the driving state of the heating resistance element shown in FIG. 14C.

The switching element 125 selects the resistor 180-1. The driving element 123 operates in response to a driving pulse signal output from the driving pulse circuit 124, so that an electric current flows through the resistor 180-1. This causes thermal energy to be generated in a heating area 105-13 between the electrodes 151-1 to 151-7 and the electrodes 154-1 to 154-7 shown in FIG. 16A, and the liquid in the pressure chamber 160 is heated by the thermal energy to generate bubbles. The liquid is ejected from the ejection port 140 through a series of processes, that is, generation, growth, and shrinkage of bubbles.

While the bubbles are broken, a cavitation impact occurs at a cavitation-generated position 210 in the vicinity of the center of the heating area 105-13.

Second Driving Operation

Figure 16B:
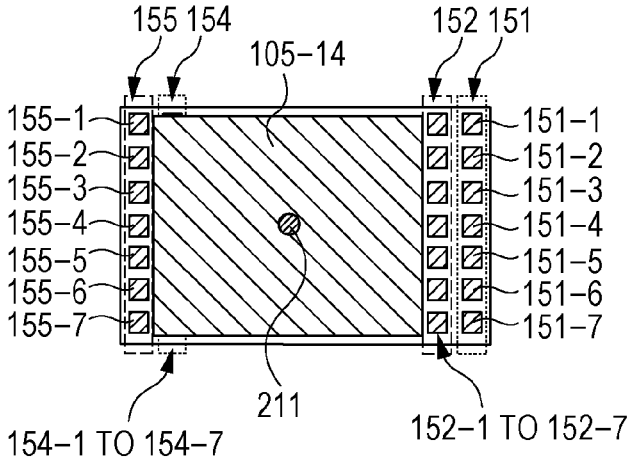
FIG. 16B is a schematic plan view showing another example of the driving state of the heating resistance element shown in FIG. 14C.

The switching element 125 selects the resistor 180-2. The driving element 123 operates in response to a driving pulse signal output from the driving pulse circuit 124, so that an electric current flows through the resistor 180-2. This causes thermal energy to be generated in a heating area 105-14 between the electrodes 152-1 to 152-7 and the electrodes 155-1 to 155-7 shown in FIG. 16B, and the liquid in the pressure chambers 160 is heated by the thermal energy to generate bubbles. The liquid is ejected from the ejection port 140 through a series of processes, that is, generation, growth, and shrinkage of bubbles.

While the bubbles are broken, a cavitation impact occurs at a cavitation-generated position 211 in the vicinity of the center of the heating area 105-14.

Figure 16C:
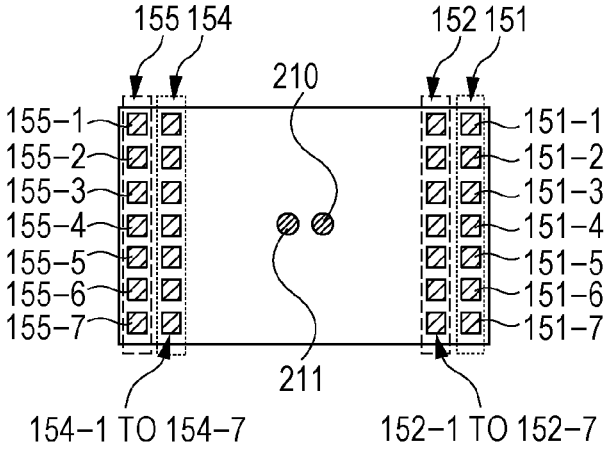
FIG. 16C is a schematic plan view illustrating the positions of cavitation generated in the driving states of the heating resistance element shown in FIGS. 16A and 16BC.

As shown in FIG. 16C, the cavitation-generated position 210 in the first driving operation differs from the cavitation-generated position 211 in the second driving operation. Thus, the selective switching between the resistors 180-1 and 180-2 with the switching element 125 can reduce concentration of cavitation-generated positions onto one location. For example, alternate first and second driving operations will cause the cavitation impact at the cavitation-generated positions 210 and 211 alternately. This can reduce the breakage of the heating resistance element 150 due to concentration of cavitation, thus enhancing the durability.

The recording-element substrate of this embodiment also has one heating resistance element for one ejection port as in the first embodiment. Thus, the size and cost can be decreased as compared with a configuration in which a plurality of heating resistance elements are provided for one ejection port.

In this embodiment, the electrodes of the heating resistance element 150 are formed not using the fourth wiring layer 110-4 but using the third vias 111-3. This allows a structure with less level difference than that of the first embodiment to be provided. This can decrease the thickness of the passivation layer 106 on the heating resistance element 150. In addition, the heating resistance element 150 and the devices and circuits for controlling ejection can also be decreased in size, so that the recording-element substrate can be decreased in size (chip size).

The number of the electrodes of the heating resistance element 150 is not limited to 28. The number of the electrodes of the heating resistance element 150 is three or more. The number and combination of electrode pairs can also be changed as appropriate provided that the heating-area formed area can be changed by selectively using two or more electrodes.

To minimize heat that escapes through the vias and wiring lines, the third wiring layer 110-3 and the third vias 111-3 disposed inside the second wiring layer 110-2 and the second vias 111-2 may be as thin as possible. For example, the third wiring layer 110-3 and the third vias 111-3 may be thinner than the second wiring layer 110-2 and the second vias 111-2.

The first to sixth embodiments are given for mere illustration and are not intended to limit the present disclosure; the configuration can be modified as appropriate.

While the liquid ejection apparatus shown in FIG. 10A has been described as an example of a liquid ejection apparatus to which the recording-element substrate of the fifth embodiment is applicable, the liquid ejection apparatus can also incorporate the recording-element substrates of the first to fourth embodiments and the sixth embodiment. However, the liquid ejection apparatus to which recording-element substrates according to some embodiments of the present disclosure are applicable is not limited to the liquid ejection apparatus shown in FIG. 10A. A recording-element substrate according to an embodiment of the present disclosure can be generally applied to liquid ejection apparatuses (inkjet recording apparatuses) that eject liquid through ejection ports using heating resistance elements.

While the present disclosure has been described with reference to exemplary embodiments, it is to be understood that the present disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2014-083633, filed Apr. 15, 2014, which is hereby incorporated by reference herein in its entirety.

What is claimed is:

1. A recording-element substrate comprising:

an ejection port configured to eject liquid;

a heating resistance element configured to generate thermal energy for ejecting the liquid from the ejection port; and a drive circuit configured to drive the heating resistance element, wherein the heating resistance element includes a heating resistor layer and three or more electrodes provided for the heating resistor layer;

the drive circuit forms a heating area that generates thermal energy in the heating resistor layer by selectively using at least two of the three or more electrodes and changes an area in which the heating area is formed depending on the electrodes used; and the three or more electrodes include a plurality of first electrodes that allow an electric current to flow through a first area and a plurality of second electrodes that allow an electric current to flow through a second area adjacent to the first area, a center of the first area coinciding with a center of an area including the first area and the second area.

2. The recording-element substrate according to claim 1, wherein the drive circuit controls an amount or an ejecting direction of the liquid ejected from the ejection port depending on the electrodes used.

3. The recording-element substrate according to claim 1, wherein the drive circuit supplies an electric current based on a first driving pulse signal to the first area via the plurality of first electrodes and supplies an electric current based on a second driving pulse signal to the second area via the plurality of second electrodes, the first and second driving pulse signals having a same pulse width.

4. The recording-element substrate according to claim 1, wherein the drive circuit supplies an electric current based on a first driving pulse signal to the first area via the plurality of first electrodes and supplies an electric current based on a second driving pulse signal to the second area via the plurality of second electrodes, the first and second driving pulse signals having different pulse widths.

5. The recording-element substrate according to claim 1, wherein the three or more electrodes include a plurality of first electrodes that allow an electric current to flow through a first area; a plurality of second electrodes that allow an electric current to flow through a second area on a first side of the first area; and a plurality of third electrodes that allow an electric current to flow through a third area on a second side of the first area.

6. The recording-element substrate according to claim 5, wherein the drive circuit receives a head movement signal indicating a moving speed and a moving direction of a liquid ejection head equipped with the recording-element substrate;

if the head movement signal indicates that the moving speed of the liquid ejection head is less than a threshold value, uses the plurality of first electrodes;

if the head movement signal indicates that the moving speed of the liquid ejection head is equal to or higher than the threshold value and that the liquid ejection head is moving toward the first side, uses the plurality of second electrodes; and if the head movement signal indicates that the moving speed of the liquid ejection head is equal to or higher than the threshold value and that the liquid ejection head is moving toward the second side, uses the plurality of third electrodes.

7. The recording-element substrate according to claim 5, wherein the drive circuit supplies an electric current based on a first driving pulse signal to the first area via the plurality of first electrodes, supplies an electric current based on a second driving pulse signal to the second area via the plurality of second electrodes, and supplies an electric current based on a third driving pulse signal to the third area via the plurality of third electrodes, the first to third driving pulse signals having a same pulse width.

8. The recording-element substrate according to claim 5, wherein the drive circuit supplies an electric current based on a first driving pulse signal to the first area via the plurality of first electrodes, supplies an electric current based on a second driving pulse signal to the second area via the plurality of second electrodes, and supplies an electric current based on a third driving pulse signal to the third area via the plurality of third electrodes, the first to third driving pulse signals having different pulse widths.

9. The recording-element substrate according to claim 1, wherein the heating resistor layer is formed on a substrate, and the three or more electrodes are formed on a side of the heating resistor layer adjacent to the substrate.

10. A liquid ejection apparatus comprising a liquid ejection head equipped with the recording-element substrate according to claim 1.

11. A recording-element substrate comprising:

an ejection port configured to eject liquid;

a heating resistance element configured to generate thermal energy for ejecting the liquid from the ejection port; and a drive circuit configured to drive the heating resistance element, wherein the heating resistance element includes a heating resistor layer and three or more electrodes provided for the heating resistor layer;

the drive circuit forms a heating area that generates thermal energy in the heating resistor layer by selectively using at least two of the three or more electrodes and changes an area in which the heating area is formed depending on the electrodes used; and the three or more electrodes include a plurality of first electrodes that allow an electric current to flow through a first area and a plurality of second electrodes that allow an electric current to flow through a second area larger than the first area, a center of the first area coinciding with a center of the second area.

12. The recording-element substrate according to claim 11, wherein the drive circuit controls an amount or an ejecting direction of the liquid ejected from the ejection port depending on the electrodes used.

13. The recording-element substrate according to claim 11, wherein the drive circuit supplies an electric current based on a first driving pulse signal to the first area via the plurality of first electrodes and supplies an electric current based on a second driving pulse signal to the second area via the plurality of second electrodes, the first and second driving pulse signals having a same pulse width.

14. The recording-element substrate according to claim 11, wherein the drive circuit supplies an electric current based on a first driving pulse signal to the first area via the plurality of first electrodes and supplies an electric current based on a second driving pulse signal to the second area via the plurality of second electrodes, the first and second driving pulse signals having different pulse widths.

15. The recording-element substrate according to claim 11, wherein the three or more electrodes include a plurality of first electrodes that allow an electric current to flow through a first area; a plurality of second electrodes that allow an electric current to flow through a second area on a first side of the first area; and a plurality of third electrodes that allow an electric current to flow through a third area on a second side of the first area.

16. The recording-element substrate according to claim 15, wherein the drive circuit receives a head movement signal indicating a moving speed and a moving direction of a liquid ejection head equipped with the recording-element substrate;

if the head movement signal indicates that the moving speed of the liquid ejection head is less than a threshold value, uses the plurality of first electrodes;

if the head movement signal indicates that the moving speed of the liquid ejection head is equal to or higher than the threshold value and that the liquid ejection head is moving toward the first side, uses the plurality of second electrodes; and if the head movement signal indicates that the moving speed of the liquid ejection head is equal to or higher than the threshold value and that the liquid ejection head is moving toward the second side, uses the plurality of third electrodes.

17. The recording-element substrate according to claim 15, wherein the drive circuit supplies an electric current based on a first driving pulse signal to the first area via the plurality of first electrodes, supplies an electric current based on a second driving pulse signal to the second area via the plurality of second electrodes, and supplies an electric current based on a third driving pulse signal to the third area via the plurality of third electrodes, the first to third driving pulse signals having a same pulse width.

18. The recording-element substrate according to claim 15, wherein the drive circuit supplies an electric current based on a first driving pulse signal to the first area via the plurality of first electrodes, supplies an electric current based on a second driving pulse signal to the second area via the plurality of second electrodes, and supplies an electric current based on a third driving pulse signal to the third area via the plurality of third electrodes, the first to third driving pulse signals having different pulse widths.

19. The recording-element substrate according to claim 11, wherein the heating resistor layer is formed on a substrate, and the three or more electrodes are formed on a side of the heating resistor layer adjacent to the substrate.

20. A liquid ejection apparatus comprising a liquid ejection head including the recording-element substrate according to claim 11.

* * * * *